US006095472A

United States Patent [19]

Hubbard et al.

[11] Patent Number: 6,095,472

[45] Date of Patent: Aug. 1, 2000

[54] RESTRAINING SYSTEM FOR WATER HEATERS

[75] Inventors: Kirt R. Hubbard, Kirkland, Wash.; Larry D. Brown, San Diego, Calif.

[73] Assignee: Securus, Inc., San Marcos, Calif.

[21] Appl. No.: 09/042,309

[22] Filed: Mar. 13, 1998

Related U.S. Application Data

[63] Continuation-in-part of application No. 09/006,084, Jan. 14, 1998

[60] Provisional application No. 60/048,361, Jun. 2, 1997, and provisional application No. 60/051,824, Jul. 7, 1997.

[51] Int. Cl.[7] ..... A47B 96/06

[52] U.S. Cl. ..... 248/313; 248/225.11

[58] Field of Search ..... 248/313, 154, 248/309.1, 146, 74.3, 74.1, 505, 499, 311.2, 230.8; 220/480, 481, 565; 24/20 LS, 284, 280, 279; 126/554, 24, 363; 431/343; 292/256.64

[56] References Cited

U.S. PATENT DOCUMENTS

| | | | |
|---|---|---|---|
| 2,835,954 | 5/1958 | Dahl | 24/279 |
| 3,317,974 | 5/1967 | Sisler | 24/279 |
| 3,579,754 | 5/1971 | Oetiker | 24/279 |
| 4,020,531 | 5/1977 | Ahrens et al. . | |
| 4,783,030 | 11/1988 | Buerhop . | |
| 4,955,573 | 9/1990 | Horvath . | |
| 5,020,760 | 6/1991 | Mayr . | |
| 5,085,387 | 2/1992 | Peterson et al. . | |
| 5,131,133 | 7/1992 | Peterson et al. . | |
| 5,190,260 | 3/1993 | Daubenspeck . | |
| 5,344,111 | 9/1994 | Gantzert . | |
| 5,393,024 | 2/1995 | Daubenspeck . | |
| 5,487,518 | 1/1996 | McCraney et al. . | |
| 5,851,038 | 12/1998 | Robinson | 292/256.67 |

*Primary Examiner*—Ramon O. Ramirez
*Assistant Examiner*—Gwendolyn Baxter
*Attorney, Agent, or Firm*—Stetina Brunda Garred & Brucker

[57] ABSTRACT

A water heater is restrained against movement, such as during an earthquake, by a restraining system. The restraining system includes a pair of adjustable straps, which accommodate water heaters of various sizes. One end of each strap is securely attached to a supporting surface, such as a wall. The other end of the straps contain a plurality of slots configured to receive a connector. A connector is positioned in a desired slot or slots in each strap such that when the straps are placed around the water heater, the connectors are positioned proximate to each other. An adjustable fastener such as a bolt is inserted through an aperture in each connector to adjustably fasten the connectors together. The adjustable connector allows fine adjustment of the tension of straps around the water heater.

32 Claims, 13 Drawing Sheets

FIG. 11
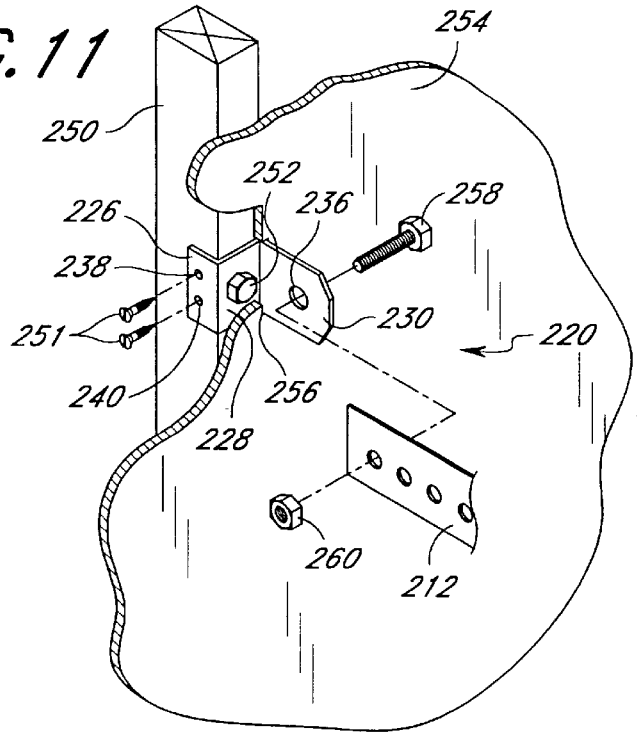
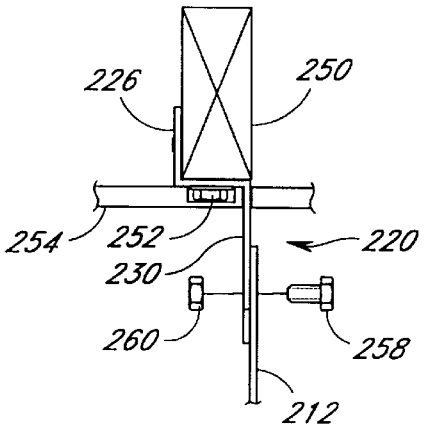
FIG. 12
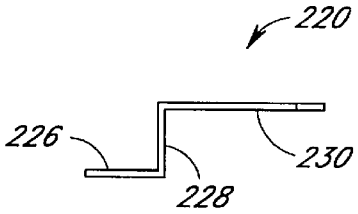
FIG. 13
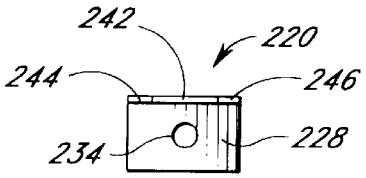
FIG. 14
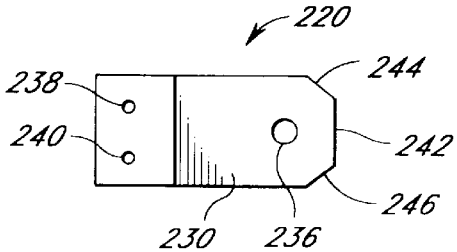
FIG. 15

RESTRAINING SYSTEM FOR WATER HEATERS

This application claims the benefit under 35 U.S.C. § 119 (e) of Application Ser. No. 60/048,361 filed Jun. 2, 1997 and Application Ser. No. 60/051,824 filed Jul. 7, 1997, and is a continuation-in-part of Application Ser. No. 09/006,084 filed Jan. 14, 1998.

BACKGROUND OF THE INVENTION

This invention relates generally to water heaters and, in particular, to a system for restraining water heaters.

Conventional water heaters are generally cylindrical in overall shape, often between about four and six feet tall, and placed in an upright position. It is important for water heaters to remain in an upright position, in spite of disturbances such as earthquakes. A conventional method for securing a water heater in an upright position is to wrap a simple cable or strap around the water heater and attach the cable or strap to a nearby wall. This method, however, is unsatisfactory because the water heater is often an unknown distance from the wall and water heaters typically have different sizes. Thus, cables or straps of various lengths are required, and installation time is lengthened. Additionally, these simple cables or straps can be very difficult to install, and it is very difficult to obtain the proper tension in the cables or straps around the water heater. Therefore, the water heater is often improperly supported.

SUMMARY OF THE INVENTION

The present invention is a simple and economical system for restraining water heaters. Advantageously, the system is readily adjustable to restrain water heaters of various sizes. For example, the restraining system can restrain residential water heaters, which typically contain 30, 40 or 50 gallons of water. The restraining system can also restrain larger and smaller water heaters, and commercial water heaters. The restraining system is also readily adjustable to restrain water heaters located at various distances from a supporting structure, such as a wall. Additionally, the system is relatively inexpensive to manufacture because it has few parts and the parts have relatively simple construction. Further, the system provides for fast and efficient installation because the system is easy to assemble and readily adjustable.

In one embodiment of the present invention, the restraining system includes a first strap having a first end connected to a support structure and a second end containing a plurality of slots. A second strap has a first end connected to the support structure and a second end containing plurality of slots. The restraining system also includes a first connector including an extension configured to extend through a selected slot in the first strap and a second connector including an extension configured to extend through a selected slot in the second strap. Additionally, the system includes an adjustable fastener configured to connect the first and second connectors. The slot which is selected in the first strap and the slot which is selected in the second strap are selected for coarse adjustment of the straps around the water heater, and the adjustable fastener is configured to tighten the straps around the water heater to achieve the desired fit of the straps around the water heater.

In another embodiment of the invention, the restraining system further includes a bracket connected to a supporting structure and a pair of wedges connected to the bracket. Each wedge includes a first leg and a second leg, with the first leg of each wedge configured to engage the water heater.

In yet another embodiment of the invention, a mounting bracket with a generally "Z"-shaped configuration has a first section for engagement with an inner surface of a supporting member, a second section extending generally perpendicular to the first for engagement with the front face of the supporting member, and a third or attachment section extending generally perpendicular to the second section (and generally parallel to the first section). The bracket includes a through-hole in its second section through which a fastener may be extended for connecting the bracket to the front face of the supporting member and the bracket may include a pair of through-holes in the first section through which additional fasteners may be extended. Desirably, when a wall covering is installed over the front face of the supporting member, the attachment section of the bracket extends through the wall covering and includes a point of attachment for the end of a strap or other restraint.

The invention also includes a method of restraining a water heater; the method includes the steps of attaching a first strap with a plurality of apertures to a supporting structure and attaching a second strap with a plurality of apertures to a supporting structure. A first connector is inserted through selected slots in the first strap and a second connector is inserted through selected slots in the second strap. An adjustable fastener connects the first and second connectors. The adjustable fastener is preferably configured to tighten the first strap and the second strap around the water heater.

In another method of restraining a water heater, two Z-shaped brackets are each mounted to different supporting members and the water heater is generally positioned between the brackets. The first section of each bracket is connected to an inner or side face of the supporting member, with a second section of each bracket connected to an end face or front face of the supporting member. A strap is then connected to each of the brackets and the ends of the straps are then positioned around the water heater. A connector joins the ends of the straps around the water heater to restrain the water heater.

Other features and advantages of the invention will become apparent to those skilled in the art upon review of the following figures, detailed description of preferred embodiments and claims.

BRIEF DESCRIPTION OF THE DRAWINGS

These and other features of the invention will now be described with reference to the drawings of preferred embodiments, which are intended to illustrate and not to limit the invention, in which:

FIG. 11 is an exploded perspective view of a portion of still another embodiment of the present invention, illustrating a bracket mounted to a wall stud and extending through a hole in a wall covering, and illustrating an end of a water heater restraining strap for connection to the bracket;

FIG. 12 illustrates a top view of the bracket illustrated in FIG. 11 as connected to a wall stud and for connection to a restraining strap;

FIG. 13 is a top view of the bracket illustrated in FIG. 11;

FIG. 14 is a front view of the bracket illustrated in FIG. 11;

FIG. 15 is a side view of the bracket illustrated in FIG. 11;

DETAILED DESCRIPTION OF THE PREFERRED EMBODIMENT

Figure 1:
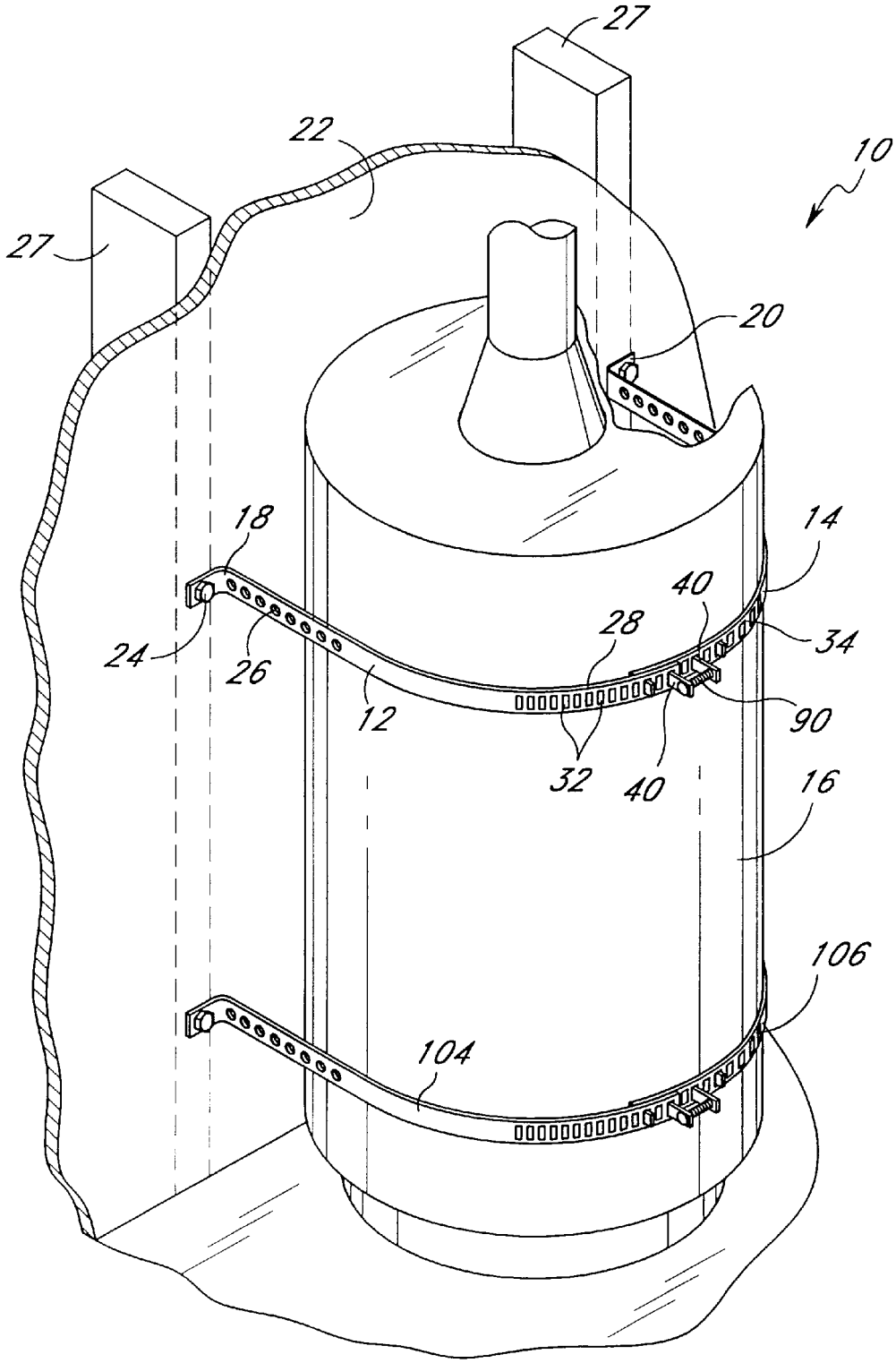
FIG. 1 is a perspective view of a preferred embodiment of the present invention.

Referring to FIG. 1, the water heater restraining system 10 includes two upper straps 12 and 14. The straps 12 and 14 extend around at least a portion of a water heater 16 mounted in a generally upright position. The water heater 16 shown in FIG. 1 is a conventional water heater with a generally cylindrical outer surface. It will be understood that the restraining system 10 can also be used to restrain or support water heaters of different configuration, and in other applications to restrain or support objects other than water heaters.

Each strap 12 and 14 has a first end 18 and 20, respectively, which is attached to a support structure 22. The support structure 22 is a generally rigid structure such as a wall or other upright support. As seen in FIG. 1, the first end 18 of the strap 12 is attached to the support structure 22 by a fastener 24. The fastener 24 includes any known method of fastening-such as nails, screws, threaded fasteners, bolts and glue, and various brackets. The first end 18 of the strap 12 includes one or more apertures 26 through which fastener 24 extends to make it easier to fasten the strap 12 to the support structure 22. Desirably, if the fastener 24 is connected to a support structure 22 comprising a wall, then the fastener 24 is attached to a stud 27. Similarly, the first end 20 of the strap 14 is also attached to the support structure 22 by a fastener in the same manner as end 18.

The straps 12 and 14 have a length which allows the first ends 18 and 20 to be fastened to the support structure 22 and second ends 28 and 30, respectively, to encircle the water heater 16, or to preferably encircle at least a sufficient portion of the water heater 16 such that the water heater 16 may be restrained. The straps 12 and 14 may be of equal or unequal length, as long as the combined length of the straps 12 and 14 is sufficient to encircle at least a portion of the water heater 16. Desirably the second ends 28 and 30 overlap to allow connection of the straps 12, 14 around the water heater 16. The length of the straps 12 and 14 may vary, for example, depending upon the size of the water heater, distance of the water heater from the support structure 22, or positioning of the water heater from the studs 27 in a supporting wall.

The straps 12 and 14 have a width and thickness sufficient to restrain the water heater 16 in an upright position. Desirably, the straps 12 and 14 have at least sufficient strength to support the water heater 16 during an earthquake. Preferably, the straps 12 and 14 are constructed from a metal such as steel or aluminum, and have a width of about 1.50 inches (3.80 cm) and a thickness of about 0.03 inches (0.076 cm). Other materials such as plastics or fabrics may also be used as long as the material provides sufficient strength to support the water heater 16 in the generally upright position under the load conditions required by the user.

The second ends 28, 30 of the straps 12, 14 include a plurality of holes that preferably comprise elongated slots 32 and 34, respectively. The slots 32 and 34 are desirably generally rectangular in configuration and the longer axis of the slots 32, 34 extends generally parallel to the width of the straps 12, 14. The slots 32, 34 are about 0.17 inches (0.43 cm) in width and about 0.85 inches (2.16 cm) in length. The slots 32, 34 can be also be larger or smaller in size, or different in shape. For example, the longer axis of the slot may extend generally perpendicular to the width of the strap and the slots may, for example, be circular, oblong or square. The plurality of slots 32, 34 are preferably spaced an equal distance apart. For example, the slots 32, 34 are preferably spaced about 1 inch (2.54 cm) apart. The slots 32, 34 may also be spaced closer together or farther apart, provided the slots 32, 34 are equally spaced. The slots may also be placed in adjacent rows with two or more slots positioned between the opposing edges of the strap. These slots advantageously have a generally constant distance separating the slots and a generally constant distance between the slots and the edge of the strap.

Figure 2:
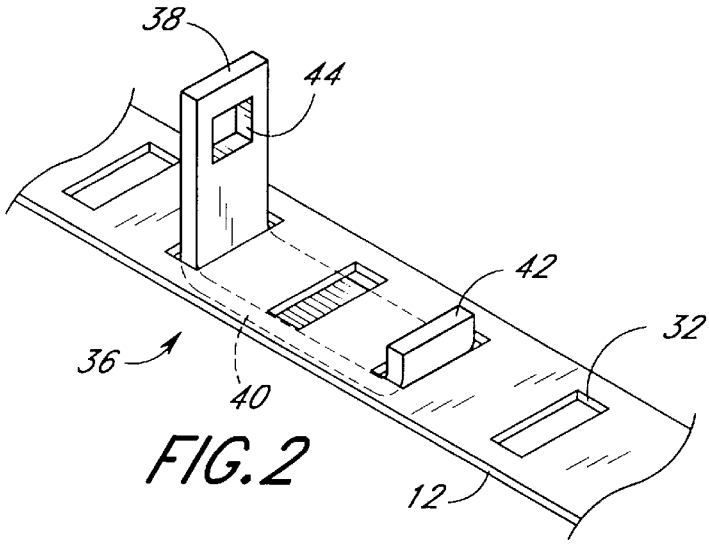
FIG. 2 is an enlarged, perspective view of a portion of the embodiment shown in FIG. 1, illustrating the connector.

As seen in FIGS. 1 and 2, the water heater restraining system 10 includes a clip or connector 36. As described below, the connector 36 is used to secure the straps 12, 14 about the water heater 16. The connector 36 includes a first end 38, a body 40 and a second end 42. The first end 38 and second end 42 are generally rectangular in configuration and extend in the same direction at about a 90° angle relative to the body 40 of the connector 36. The first end 38 preferably has a length greater than the length of second end 42, and the first end 38 includes an aperture 44. In particular, the first end 38 is about 1.50 inches (3.80 cm) in length, while the second end 42 is about 0.50 inches (1.27 cm) in length. The first and second ends 38, 42 can also be longer or shorter, but the ends 38, 42 have a length sufficient to extend through the slots 32, 34 respectively and to perform the functions described below.

The body 40 of the connector 36 is generally rectangular in shape and has a length approximately equal to the distance separating the one or more slots 32, 34. For example, the body 40 may have a width of about 0.75 inches (1.91 cm) and a length which is generally equal to the distance between adjacent slots so that the distance between the ends 38 and 42 of the connector 36 generally corresponds to the distance between the adjacent slots. More preferably, the body 40 has a length such that the distance between the center portion of the ends 38 and 42 of the connector 36 is generally equal to the distance between the center portions of the adjacent slots. Thus, in this example, the connector 36 is preferably about 1.00 inches (2.54 cm) in length between the center portion of end 38 and the center portion of end 42. The connector body 40 may also have a length that is a multiple of the distance separating the adjacent slots. Desirably, the body 40 has a length that is twice the distance separating the slots. In the preferred embodiment, the body 40 is about 2.00 inches (5.08 cm) in length between the center portion of end 38 and the center portion of end 42.

The width and thickness of the first and second ends 38, 42 of the connector 36 are sized smaller than the corresponding size of the slots 32, 34 in the straps 12, 14 to allow the first and second ends to be inserted through the slots. The first and second ends 38, 42 of the connector 36 can be readily inserted into the corresponding slots 32, 34 because the length of the body 40 is a multiple of the distance between the slots. Desirably, the slots 32, 34 and the ends 38, 42 have corresponding shapes and sizes to minimize the size of the slots in the straps 12, 14. Advantageously, this increases the strength of the straps. Additionally, the width and thickness of the ends 38, 42 are configured to fill almost the entire slot to increase the strength of the connector 36.

Figure 3:
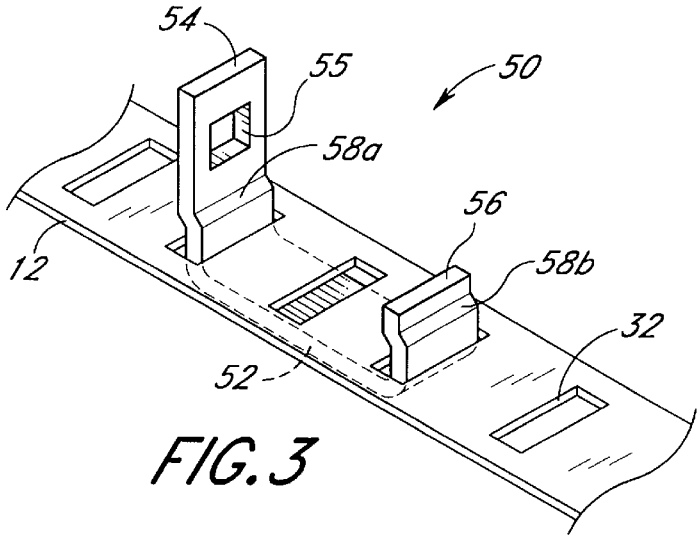
FIG. 3 is a perspective view of another embodiment of the connector shown in FIG. 2.

Another embodiment of a connector 50 is seen in FIG. 3. In this embodiment, the connector 50 includes a body 52, a first end 54 containing an aperture 55, and a second end 56. The first and second ends 54 and 56 also include angled sections 58*a* and 58*b*, respectively. The angled sections 58*a* and 58*b* extend preferably at about a 45° angle relative to the length of the first and second ends 54 and 56 or the body 52, and the angled sections are about the same distance from the body 52. The angled sections offset the free ends of ends 54, 56 from the generally perpendicular connection of the ends 54, 56 with the body 52. The angled sections 58*a* and 58*b* advantageously assist in keeping the connector 50 within the slots 32, 34 of the straps 12, 14 respectively. As seen in FIG. 3, the distance between ends 54, 56 is twice the distance between the slots 32 in the strap 12.

Figure 4:
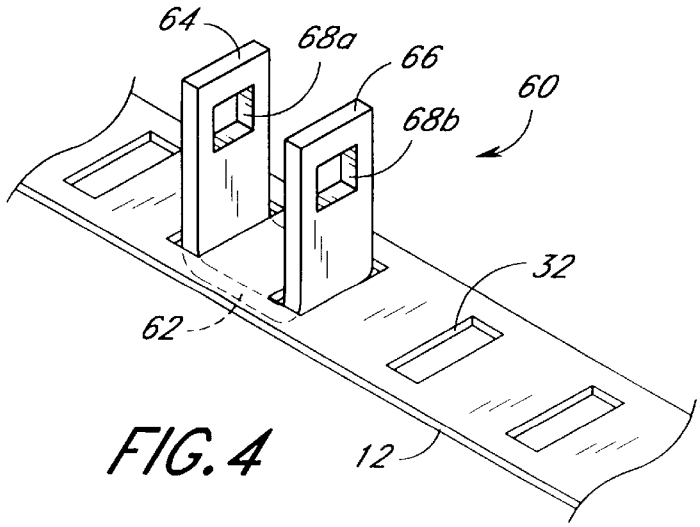
FIG. 4 is a perspective view of yet another embodiment of the connector shown in FIG. 2.

As seen in FIG. 4, another embodiment of a connector 60 includes a body 62, a first end 64 and a second end 66 generally perpendicular to body 62 and straps 12 or 14. The first and second ends 64 and 66 are about the same length to form a generally U-shaped connector that may be formed by bending a flat strap of material in a U-shape. Both the first and second ends 64, 66 contain an aperture 68*a* and 68*b* respectively, but a single aperture in the first end 64 may also be used. As seen in FIG. 4, the length of the body 62 is generally equal to the distance between two adjacent slots 32 in the strap 12.

Figure 5A:
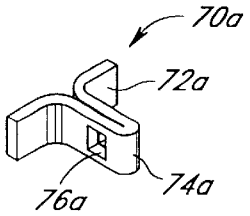
FIG. 5A is a perspective view of still another embodiment of the connector shown in FIG. 2.
Figure 5B:
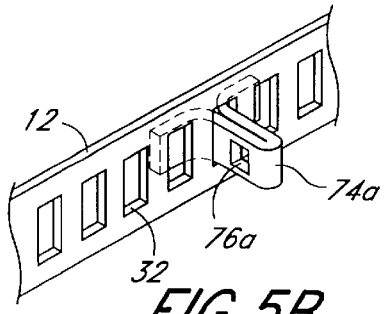
FIG. 5B is a perspective view of the connector shown in FIG. 5A, illustrating the connector inserted through a slot in a strap.

Other examples of connectors that may be used with the water heater restraining system 10 are shown in FIGS. 5A–5H, generally denoted as connector 70 and with various versions denoted as 70*a*–70*h*, but it will be appreciated that other types of connectors may also be used in view of the present disclosure. As seen in FIG. 5A, connector 70*a* includes a generally rectangular base 72*a* and a generally rectangular projection 74*a* with an aperture 76*a*. The projection 74*a* is perpendicular to the base 72*a*, and preferably positioned near the middle of the base 72*a*. The projection 74*a* is configured to fit through the slots 32, 34 in the straps 12, 14. The base 72*a*, however, is sized to prevent the connector 70*a* from being pulled through the slots 32, 34. For example, the base 72*a* may be wider and/or longer than the slot. As shown in FIGS. 5A and 5B, the projection 74*a* and the slots 32 are generally rectangular in configuration. Advantageously, when the projection 74*a* is inserted through a single slot 32 in the strap 12, the connector 70*a* provides more localized bending of the strap 12 than the previously described connectors because each connector 70*a* extends through only one slot 32, instead of extending through two slots in the embodiments described above. Because the connector 70*a* extends through only one slot 32, the slots can have any desired spacing between adjacent slots, and the spacing need not be uniform. Additionally, the connector 70*a* may be simpler and easier to make than the previously described embodiments because it may be formed by bending a single strip of metal.

Figure 5C:
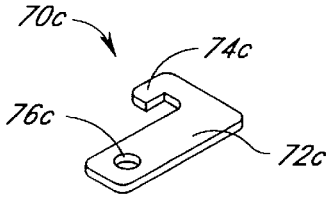
FIG. 5C is a perspective view of still another embodiment of the connector shown in FIG. 2.
Figure 5D:
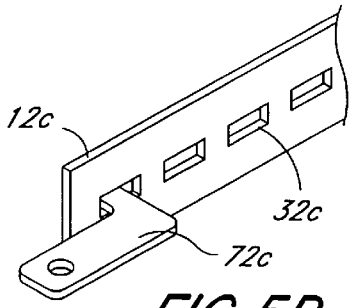
FIG. 5D is a perspective view of the connector shown in FIG. 5C, illustrating the connector inserted through a slot in a strap.

As shown in FIGS. 5C and 5D, the connector 70*c* includes a body 72*c* with a hook portion 74*c* at one end and an aperture 76*c* at the other end. The hook portion 74*c* is configured to fit through slots 32*c* in the strap 12*c*. In this embodiment, the longer axis of the slot 32*c* extends generally perpendicular to the width of the strap 12*c*. Of course, the slots 32*c* and hook portions 74*c* may have a variety of shapes and configurations. Advantageously, the connector 70*c* can be stamped from a piece of sheet metal and no bending or shaping of the connector is required.

Figure 5E:
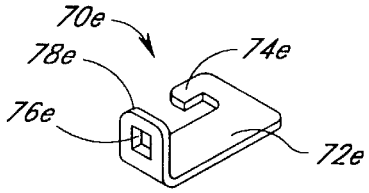
FIG. 5E is a perspective view of still another embodiment of the connector shown in FIG. 2.
Figure 5F:
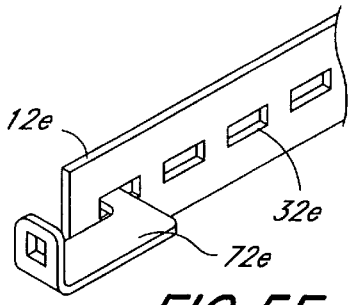
FIG. 5F is a perspective view of the connector shown in FIG. 5E, illustrating the connector inserted through a slot in a strap.

Another embodiment of the connector 70 is shown in FIGS. 5E and 5F. This connector 70*e* includes a body 72*e* with a hook portion 74*e* at one end and an aperture 76*e* at the other end. The aperture 76*e* is located in a bent portion 78*e* which is at an angle of about 90° with respect to the body 72*e*. As shown in FIG. 5E, the hook portion 74*e* is configured to fit through one of the slots 32*e* in the strap 12.

Figure 5G:
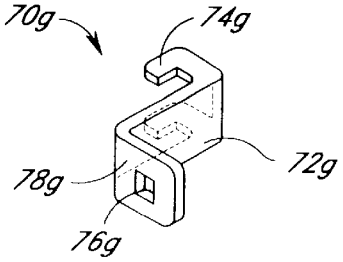
FIG. 5G is a perspective view of still another embodiment of the connector shown in FIG. 2.
Figure 5H:
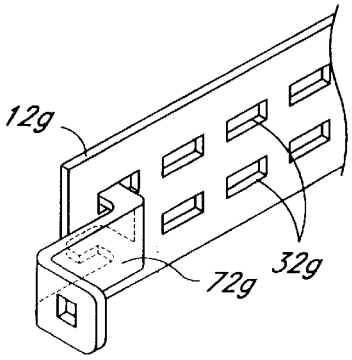
FIG. 5H is a perspective view of the connector shown in FIG. 5G, illustrating the connector inserted through a slot in a strap.

As shown in FIGS. 5G and 5H, the connector 70*g* includes a body 72*g* with a pair of hook portions 74*g* at one end configured to engage a pair of slots 32*g* in the strap 12*g*. The other end of the connector 70*g* includes an aperture 76*g* in an angled or bent portion 78*g*. The bent portion 78*g* is preferably at an angle of about 90° with respect to the body 72*g* of the connector 70*g*. Although not shown, the bent portion 78*g* may be supported by one or more gussets. The embodiment of FIGS. 5G and 5H can advantageously be stamped out of sheet metal and bent into shape, with a hole 76*g* punched into one end, and a U-shaped slot cut into an opposing end of the strip so that two 90° bends can form the hook portions 74*g*.

Figure 6A:
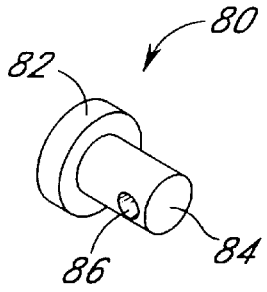
FIG. 6A is a perspective view of a further embodiment of the connector shown in FIG. 2.
Figure 6B:
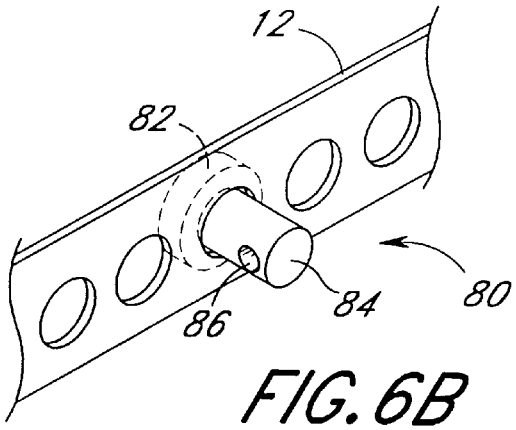
FIG. 6B is a perspective view of the connector shown in FIG. 6A, illustrating the connector inserted through a slot in a strap.

Another embodiment of a connector 80 is shown in FIGS. 6A and 6B. As seen in FIG. 6A, the connector 80 has a generally circular, disk-like base 82. From the center of the base 82 extends a generally cylindrical projection 84 and an aperture 86 extends through the projection 84. The projection 84 is configured to fit though one of the generally circular plurality of apertures 88 in the strap 12. The base 82 is sized to prevent the connector 80 from being pulled through the apertures 88. The base 82 may be cold headed on the end of cylindrical projection 84. It will be appreciated that various shapes and sizes of connectors, projections and corresponding apertures in the straps 12, 14 may be used in view of the present disclosure.

Figure 7:
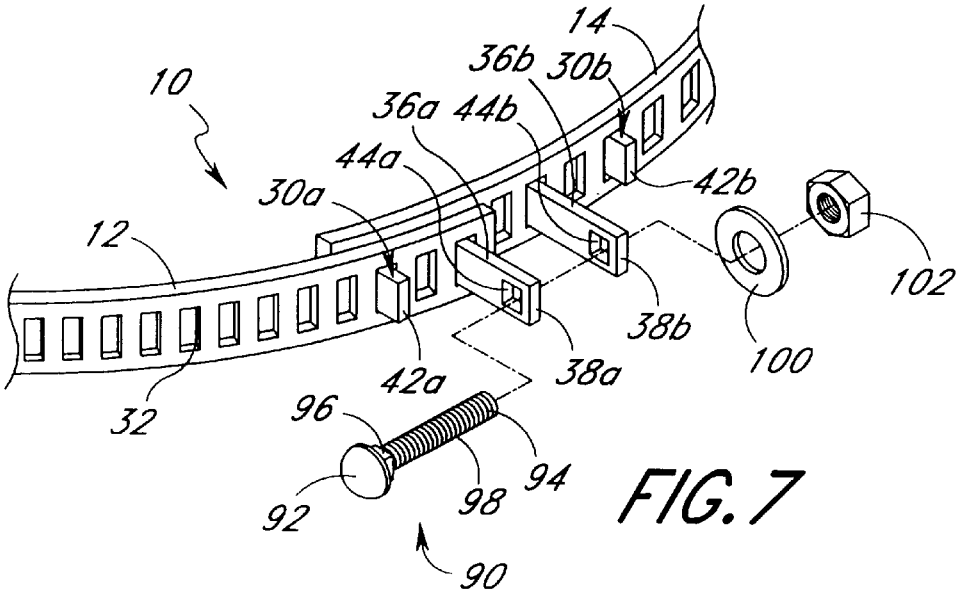
FIG. 7 is an exploded perspective view of a portion of the embodiment shown in FIG. 1 illustrating the adjustable fastener.

As shown in FIG. 7, an adjustable fastener 90 is used to fasten together a pair of connectors 36, 50, 60, 70 or 80. The adjustable fastener 90 is preferably a carriage bolt having a head 92 and a shaft 94. The shaft 94 has a non-threaded portion 96 and a threaded portion 98. The pair of connectors fastened together by the fastener 90 may be any of the embodiments described above, or any combination of embodiments. For example, as shown in FIG. 7, the adjustable fastener 90 fastens together two connectors 36*a* and 36*b* by extending through the holes in ends 38*a*, 38*b* of connectors 30*a*, 30*b* with connector 30 inserted through the second end of strap 12, and connector 30*b* inserted through the free end of strap 14. In particular, the fastener 90 extends through axially aligned apertures 44*a* and 44*b* in the first end 38*a*, 38*b* of the connectors 36*a*, 36*b*. A washer 100 is placed on the threaded portion 98 of the shaft 94 and a nut 102 is then threadably connected to the fastener 90. Desirably, the non-threaded portion 96 and the apertures 44*a*, 44*b* are generally square, with the non-threaded portion 96 configured to fit securely within either aperture 44*a* or 44*b* to restrain rotation of the fastener 90. Thus, the fastener 90 does not rotate while the nut 102 is being tightened. As seen in FIGS. 1 and 7, when the fastener 90 is tightened, the connectors 36*a* and 36*b* are pulled towards each other and this tightens the straps 12, 14 around the water heater 16.

In use, the first ends 18, 20 of the straps 12, 14 are connected to the support structure 22, for example, by fasteners 24. The straps 12, 14 are then positioned about the upper portion of the water heater 16 such that the second ends 28, 30 of the straps 12, 14 at least partially overlap. Alternatively, the ends 28, 30 of the straps 12, 14 may be positioned proximate to each other, but such that the straps do not overlap.

Any of the connectors 36, 50, 60, 70 or 80 described above, or combination thereof, may be used to fasten the straps 12, 14 together. For example, using connectors 36*a* and 36*b*, the first and second ends 38*a* and 42*a* of the first connector 36*a* are inserted through selected slots 32 in the strap 12. The connector 36*a* is positioned proximate the second end 28 of the strap 12. Preferably, the connector 36*a* is positioned one slot 32 from the second end 28 of the strap 12 . The connector 36*a* may also be positioned in the last slot, or a greater number of slots from the end of the strap 12. The strap 12 may be cut, trimmed or bent to the desired length such that the connector 36*a* is placed proximate the end of the strap 12. Additionally, the connector 36*a* is inserted into the slots 32 with the first or longer end 38*a* closer to the second end 28 of the strap 12. A second connector 36*b* is inserted in a similar manner through the slots 34 in the strap 14. As described below, the connectors 36*a* and 36*b* are placed in slots 32 and 34 respectively to provide coarse adjustment of the straps 12, 14 about the water heater 16 to position the connectors 36 sufficiently close so that the fastener 90 can connect them and draw them together to tighten the straps.

The adjustable fastener 90 is inserted through the axially aligned apertures 44*a* and 44*b* of the connectors 36*a* and 36*b* respectively. The washer 100 and nut 102 are then inserted onto the end of the shaft 94 of the fastener 90. The nut 102 is then tightened to bring the connectors 36*a* and 36*b* closer together. This tightens the straps 12, 14 around the water heater 16 and provides fine adjustment of the restraining system 10. By analogy, the fastener 90 may be inserted through the apertures 55, 68, 76, 86 of the alternative embodiments of the connectors. In all embodiments except the embodiment of FIGS. 5C and 5D, the connectors have holes that are axially aligned with the longitudinal axis of the adjustable fastener 90 so the fastener can be inserted straight through the holes. In the embodiment of FIGS. 5C and 5D, the hole 76*c* is not axially aligned with the longitudinal axis of the adjustable fastener 90, and in that embodiment a fastener 90 with a J-hook end or a projection orthogonal to the longitudinal axis of the fastener 90 can be used to engage the aperture 76*c*.

Advantageously, the restraining system 10 allows the straps 12, 14 to be quickly and efficiently adjusted to the proper length. This allows the water heater 16 to be positioned at various distances from the support structure 22 and various sizes of water heaters 16 to be restrained by the restraining system 10. In particular, the length of the straps 12, 14 are coarsely adjusted by positioning the connectors 36*a*, 36*b* in the desired slots 32, 34. If one or both of the straps 12, 14 are too long, one or both of the straps may be cut or folded to allow the correct positioning of the connectors. After the connectors 36*a*, 36*b* are positioned in the desired slots, the adjustable fastener 90 is inserted through the aligned apertures 44*a*, 44*b* and the nut 102 is tightened to provide fine adjustment of the straps 12, 14 about the water heater 16. Thus, the system 10 quickly and easily allows the straps 12, 14 to be securely fastened around the water heater 16.

Alternatively, instead of using a pair of connectors 36, 50, 60, 70 or 80 described above, a single connector can be used to connect the straps 12 and 14. For example, a connector 36, 50, 60, 70 or 80 is inserted through a selected slot 32 in the strap 12. An adjustable fastener, such as the carriage bolt described above, is inserted through a desired slot 34 or other-shaped opening in the strap 14. Preferably the strap 14 is bent at about a 90° angle proximate the selected slot 34 such that the adjustable fastener is generally aligned with the aperture in the connector. The straps 12 and 14 may be cut, trimmed or bent to the desired length such that the connector and fastener are placed proximate to each other. The fastener, which extends through the slot 34 and aperture in the connector, is then tightened to tighten the straps 12 and 14 about the water heater 16. Of course, the connector 36, 50, 60, 70 or 80 may be inserted through a selected slot 34 in the strap 14 and an adjustable fastener may be inserted through a slot 32 or other-shaped opening in the strap 12.

The straps 12, 14 are desirably positioned towards the upper section of the water heater 16. Advantageously, a second set of straps 104 and 106, with associated connectors and adjustable fasteners as described above, are positioned towards the lower section of the water heater 16. A single pair of straps may be used, or more than two pairs of straps may be used to restrain the water heater 16.

Figure 8:
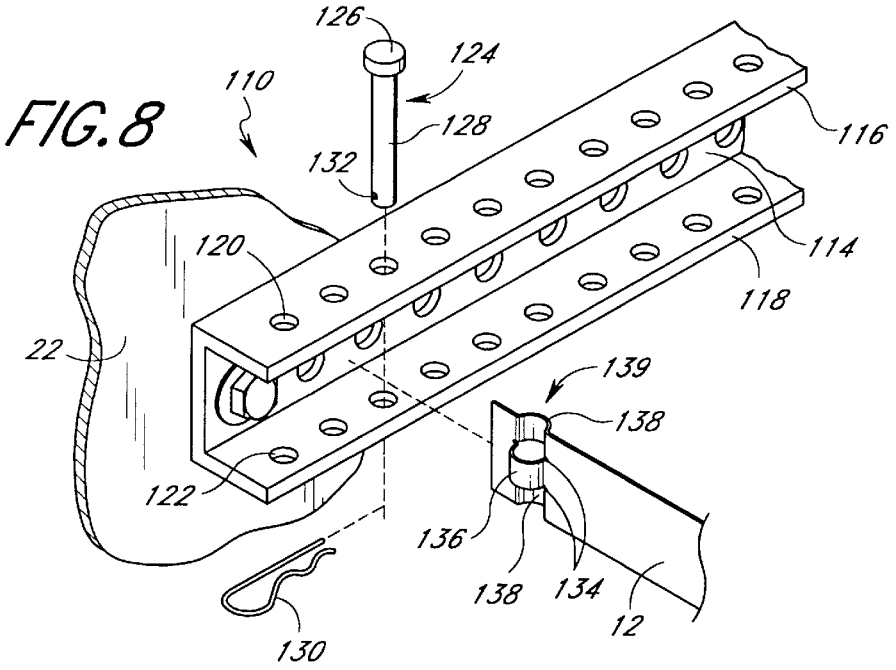
FIG. 8 is an exploded perspective view of a portion of another embodiment of the present invention, illustrating a bracket and an alternative method of securing the strap to the wall structure via the bracket.

As seen in FIG. 8, the first end 18 of the strap 12 may be connected to a bracket 110. The bracket 110 is connected by one or more fasteners 112 to the support structure 22, and preferably to at least one stud 27. The fasteners 112 (FIG. 9) may include any known means for attaching the bracket 110 to the support structure 22, such as threaded fasteners, bolts, screws, and the like. The bracket 110 is a "C" channel in cross-section which includes a body 114, an upper extension 116 and a lower extension 118. The bracket 110 is attached to the support structure 22 such that the body 114 abuts the support structure 22. The extensions 116 and 118 extend from the body 114 in the same direction and at about a 90° angle from the body 114 of the bracket 110. The extensions 116, 118 include a series of apertures 120 and 122, respectively. The series of apertures 120 and 122 are aligned to allow a fastener 124 to be inserted through adjacent apertures. The fastener 124 desirably is a pin or bolt with a head 126 and a shaft 128. The shaft 128 is configured to fit through the aligned apertures 120, 122. The fastener 124 may be secured in position by a pin 130 which may be inserted through an opening 132 which extends through the shaft 128. The fastener 124 may also be secured in position by a cotter pin, threaded nut, snap ring, threaded fastener or the like. Similarly, the first end 20 of the strap 14 is connected to the same or similar bracket 118.

The first ends 18, 20 of the straps 12, 14 are configured to receive the fastener 124 such that the straps are securely connected to the bracket 110. As shown in FIG. 8, the first end 18 of the strap 12 includes two substantially parallel slots 134 which are generally parallel to the length of the strap. The slots 134 are separated by an area 136 which is bent in a first direction generally orthogonal to the strap 12. The area 136 is preferably semi-circular in configuration and has a radius of curvature slightly larger than the fastener 124. The areas 138 between each of the slots 134 and the adjacent edges of the strap 12 are bent in a second direction opposite the first direction. The areas 138 are preferably semi-circular in configuration and have a radius of curvature slightly larger than the fastener 124. Advantageously, the areas 136 and 138 form a generally circular opening 139 in a direction substantially perpendicular to the length of the strap 12. Thus, the areas 136 and 138 cooperate to allow the fastener 124 to pass transverse to the length of the strap 12.

In use, the bracket 110 is attached to the support structure 22 by one or more fasteners 112. The opening 139 in the first end 18 of the strap 12 is aligned with the desired apertures 120, 122 in the upper and lower extensions 116, 118 of the bracket 110. The fastener 124 is inserted through the apertures 120, 122 and opening 139 to connect the strap 12 to the bracket 110. The fastener 124 is releasably secured in position by the pin 130 inserted through the opening 132 in the shaft 128. The pin 130 prevents the unintended the removal of the fastener 124. The first end 20 of the second strap 14 is connected in a similar manner to the bracket 110. There is advantageously provided a bracket that fastens to the wall 22, with the bracket having means for connecting a strap 12, 14 to the bracket.

Figure 9:
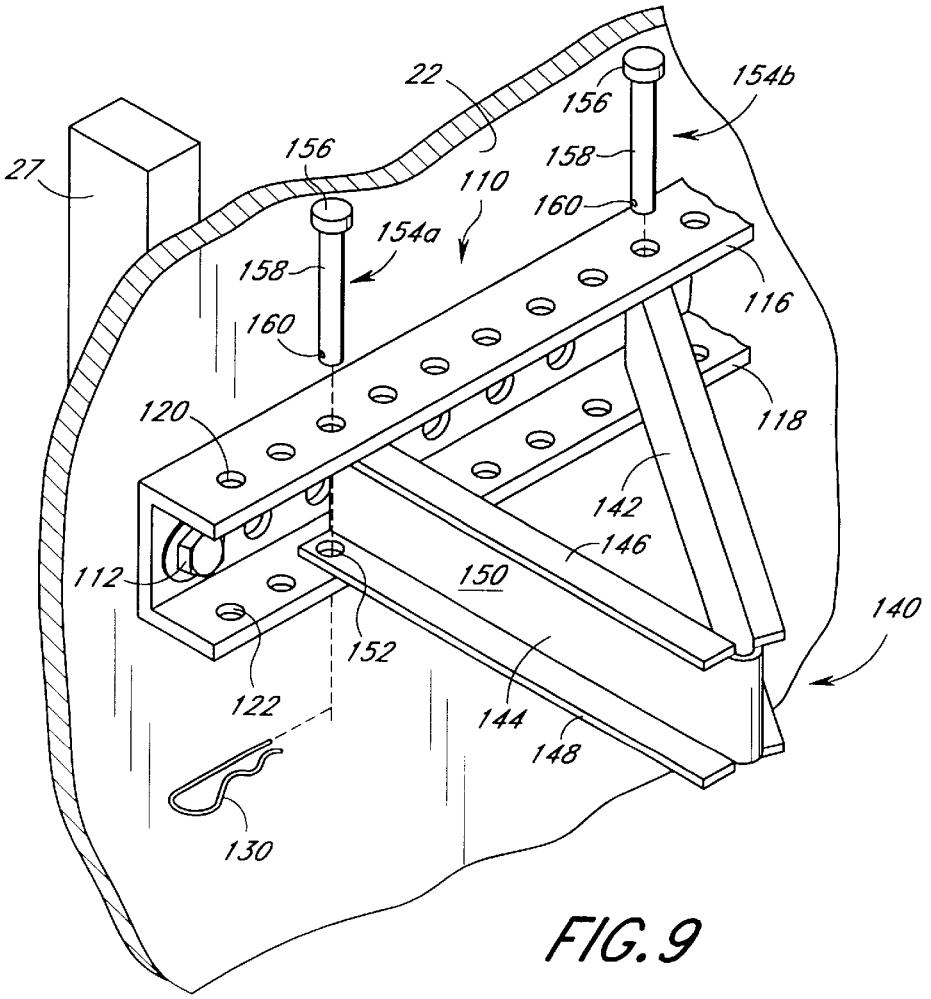
FIG. 9 is an enlarged, perspective view of a portion of yet another embodiment of the present invention, illustrating a bracket and a wedge.

As seen in FIG. 9, the restraining system 10 may also include one or more holding brackets or wedges 140 connected to the bracket 110. The wedge 140 has a V-shaped body with legs 142 and 144. Each leg 142, 144 has an upper extension or flange 146, a lower extension or flange 148 and a central body section 150 joining the flanges. The upper and lower extensions 146, 148 extend generally in the same direction and at about a 90° angle from the central body 150. The distal ends of the wedge 140 includes apertures 152 in the upper and lower extensions 146, 148. The apertures 152 are configured to receive fasteners generally denoted as fasteners 154, and illustrated as fasteners 154*a*, 154*b* so that the wedge 140 is connected to the bracket 110 in a manner similar to that described above. The fasteners 154 include a head 156, a shaft 158 and an aperture 160. The aperture 160 is configured to receive a pin 130 such as a cotter pin, threaded nut, snap ring or the like to prevent the unintended removal of the fastener 154.

The wedge 140 has a V-shape in part so that one leg 142 can be positioned proximate or adjacent one side of the water heater 16. Desirably, the wedge 140 assists in placing the water heater 16 in the desired position and limits the movement of the water heater 16. Advantageously, the leg 142 of the V-shaped wedge 140 adjacent the water heater 16 can be curved to increase the area that may contact the water heater 16. Preferably, the water heater 16 abuts the leg 142, and the portion of leg 142 abutting the water heater 16 is configured to have an engaging surface that does not puncture or damage the water heater 16. For example, if the leg 142 is formed by cutting the upper and lower extensions 146, 148 of the wedge 140 and bending the wedge at the cut, as shown in FIG. 9, the upper and lower extensions 146, 148 preferably have sufficient thickness to avoid damaging the water heater 16. Although not shown in the accompanying figures, a plate can be fastened to the leg 142 to increase the area of the wedge engaging the water heater 16. In addition, a resilient material or other flexible member may be interposed between the leg 142 and the water heater 16 to reduce damage to the water heater 16 during installation and during motion that may occur during earthquakes. For example, the leg 142, or a portion thereof, could be coated with a plastic or rubber material. The legs 142, 144 could also be bent in the opposite direction from that shown in FIG. 9 so that upper and lower extensions 146, 148 were not oriented outward to engage the water heater 16. Instead, the body 150 of the wedge 140 would engage the water heater 16.

Preferably, two wedges 140 are located on opposing sides of the water heater 16. The construction of the second wedge is similar to the wedge described above and will not be repeated. The second wedge may be fastened to the same bracket 110 as the first wedge, or the second wedge may be fastened to a different bracket. Advantageously, as described in greater detail below, the wedges 140 may be used independently or in conjunction with the straps 12, 14.

In operation, the bracket 110 is attached to the supporting surface 22 by one or more fasteners 112. The ends of the wedge 140, which are configured to fit between the upper and lower extensions 116 and 118 of the bracket 110, are attached to the bracket 110 by fasteners 154*a* and 154*b*. In particular, openings 152 in the legs 142 and 144 are aligned with selected apertures 120, 122 in the upper and lower extensions 116, 118 of the bracket 110. The fasteners 154*a* and 154*b* are inserted through the apertures 120, 122 and 152 to connect the wedge 140 to the bracket 110. The fastener 154*a* and 154*b* are releasably secured in position by the pin 130 inserted through the aperture 160 extending through the shaft of 158 of the fasteners 154*a* and 154*b*.

Figure 10:
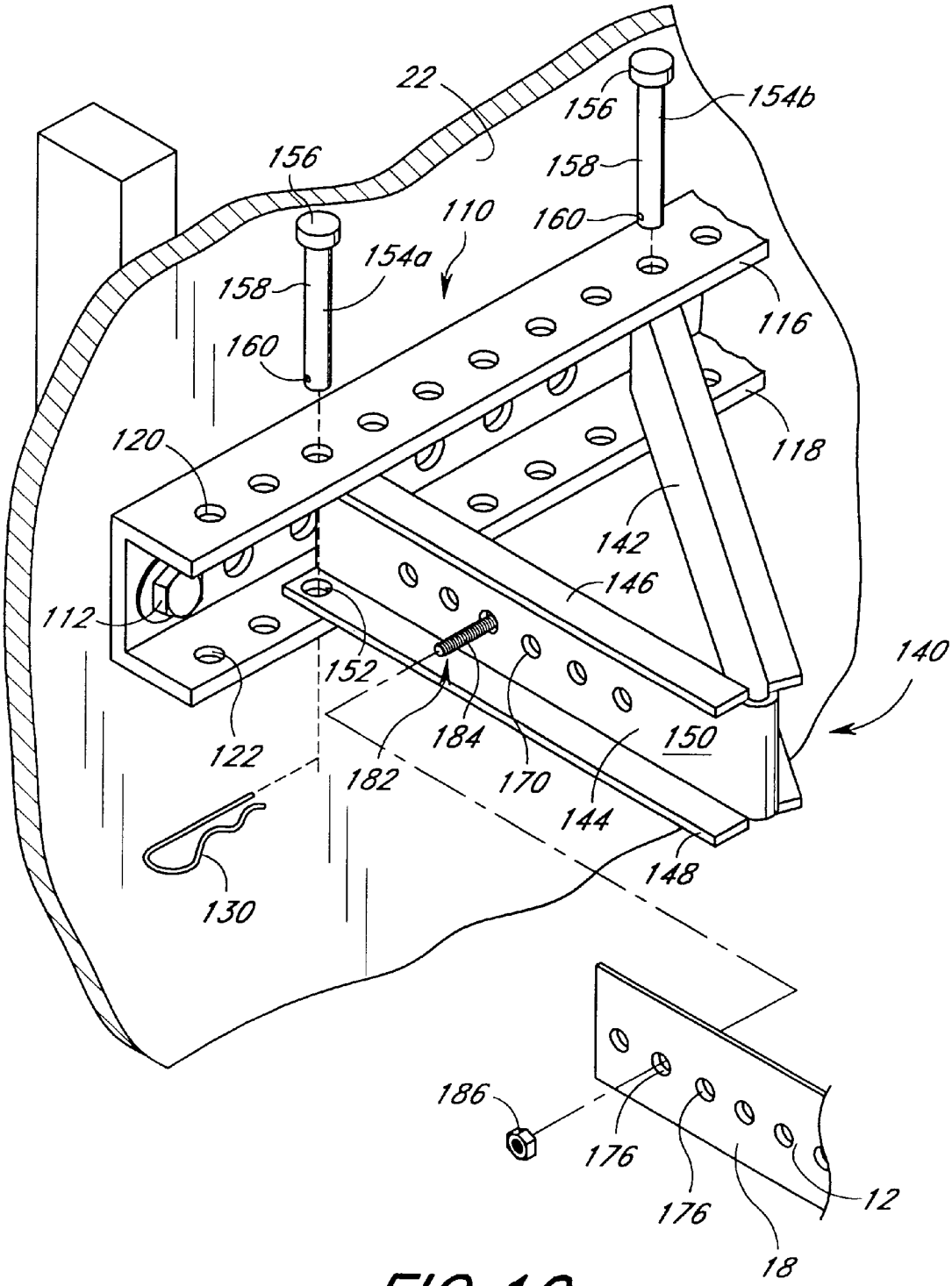
FIG. 10 is a perspective view of a portion of still another embodiment of the present invention, illustrating a bracket, a wedge and a strap.

In yet another embodiment of this invention, as shown in FIG. 10, the leg 144 of the wedge 140 has a plurality of round holes 170 located along its axis. The first end 18 of the strap 12 includes a plurality of round holes 176 located along the axis of the strap 12, of a size and shape similar to the holes 170 in the leg 144 of wedge 140. Of course, the holes 170 and 176 may have any desired shape or configuration, and any number of holes may be used depending upon the desired configuration of the restraining system.

The strap 12 is releasably secured to the wedge 140 by the use of a fastener 182. In particular, the fastener 182 is inserted through the selected hole 170 in the leg 144 and the selected hole 176 in the strap 12. The fastener 182 preferably comprises a threaded shaft 184 and a nut 186, but other threaded fasteners and removable fasteners could be used. The threaded fastener 182 allows the strap 12 to be securely connected to the wedge 140. The strap 14 on the other side of the water heater 16 may be connected to a bracket 10 or wedge 140 on the other side of the water heater 16 in any manner described above.

As seen in FIGS. 11–19, the restraining system 10 may also include a Z-shaped bracket 220 which can be connected to one or more straps which extend around the water heater. In particular, as best seen in FIGS. 11–16, the Z-shaped bracket 220 has three main sections: (1) a first section 226 for extension along the side of a wall stud 250; (2) a second section 228 which extends generally perpendicular to the first section for extension along the front face of the wall stud; and (3) an attachment section 230 which extends generally perpendicular to the second section (and parallel to the first section). The attachment section 230 extends outwardly from the wall stud 250 for attachment of the securing strap 212. There is thus advantageously provided two generally parallel sections 226 and 230 extending in opposing directions from the offset, second section 228.

As best seen in FIGS. 13–15, the bracket 220 has a Z-shaped configuration with the first section 226 having a length of about 1 inch, and the attachment section 230 having a length of about 2.5 inches so that the total length of the bracket 220 is about 3.5 inches. The bracket 220 preferably has a height of about 1.5 inches, and is constructed of 14 gauge galvanized steel. The length of the second section 228 is about 1.6 inches. It will be appreciated that the bracket 220 may also be larger or smaller, and it may be constructed from a wide range of materials having the desired strength.

As seen in FIG. 14, the bracket 220 has a hole or bore 234 positioned in the second section 228. The bore 234 is desirably centered in this second section 228 of the bracket 220, as illustrated in FIG. 14. It will be appreciated that the bore 234 may be positioned in any desired location on location 228. As seen in FIG. 15, another hole or bore 236 is positioned in the attachment section 230 of the bracket 220. This bore 236 is located approximately 1.5 inches along the attachment section 230 from the second section 228, and midway along the height of the bracket 220. This bore 236 preferably has a diameter of about 0.28 inches, slightly larger than a quarter inch diameter fastener which may extend through the bore. Additionally, two holes or bores 238 and 240 are positioned in the first section 226. These bores 238 and 240 are centered on the bracket 220, and midway along the length of the first section 226 (i.e. about 0.5 inches in from the second section 228). Desirably, the edge 242 of the attachment section 230 opposite the second section 228 has angled portions 244 and 246, which are located at about 45° and are about 0.5 inches in length. Of course, the angled portions may have any desired shape or configuration, including rounded or square. Further, it will be understood that the bracket may have any desired dimensions depending upon the particular use of the bracket 220.

Figure 16:
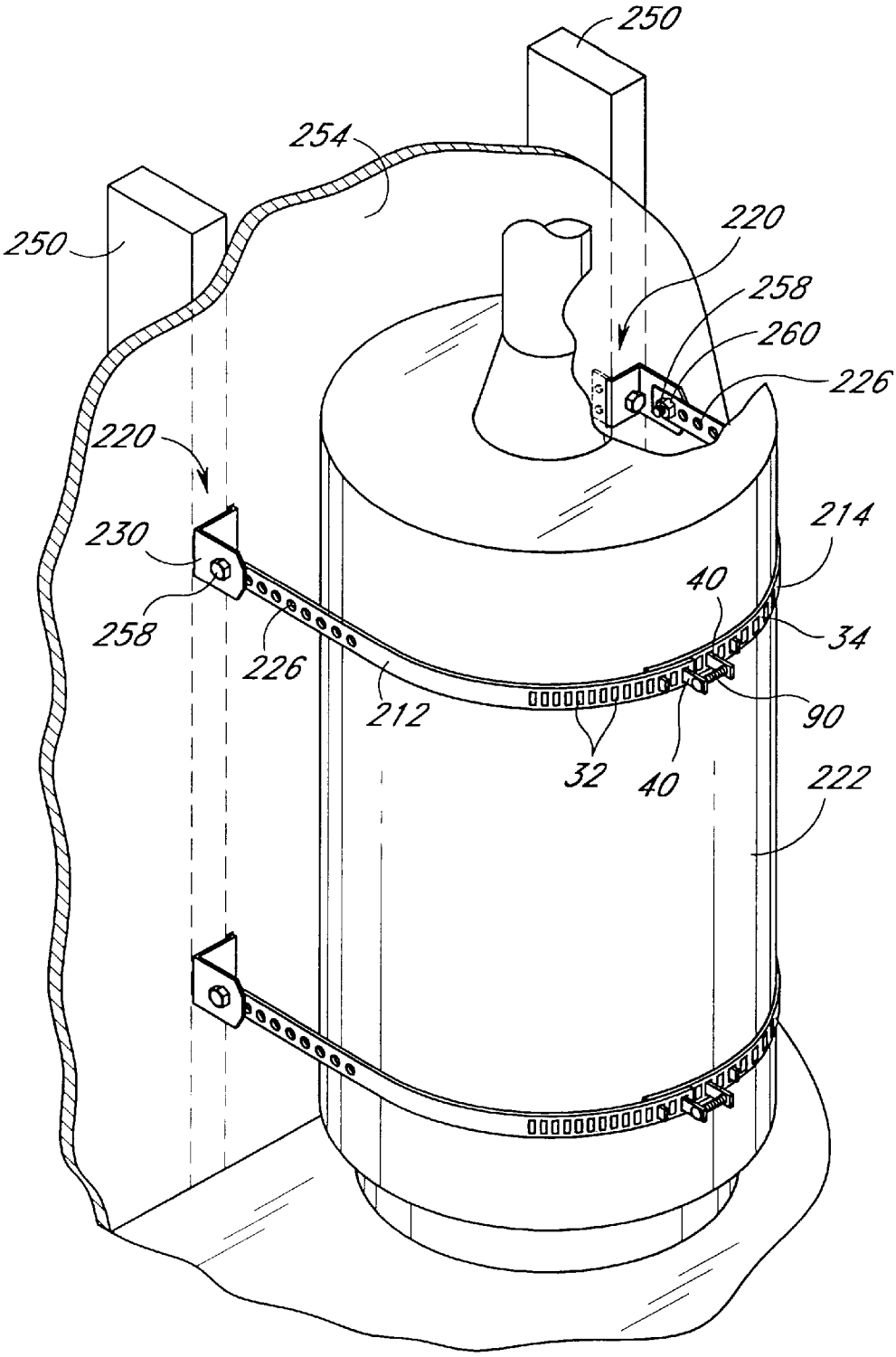
FIG. 16 is a perspective view illustrating a pair of brackets mounted to wall studs, each bracket having a portion extending through a hole in a wall covering connected to the studs, and including a strap extending around a water heater and attached to the brackets.
Figure 17:
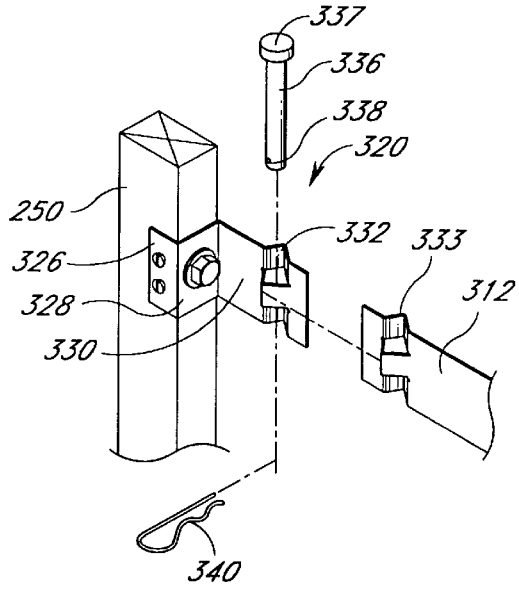
FIG. 17 illustrates an alternate embodiment bracket in accordance with the present invention, the bracket including a sliding pin type mounting arrangement for a water heater restraining strap.
Figure 18A:
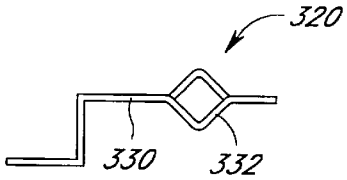
FIG. 18 illustrates a top view of the bracket illustrated in FIG. 17.
FIG. 18B illustrates a side view of the bracket illustrated in FIG. 17.
Figure 18B:
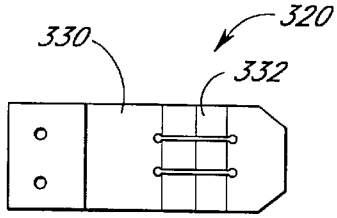

Mounting of one or more brackets 220 and its method of use in restraining a water heater 222 is best illustrated in FIGS. 11, 12 and 16. The bracket 220 is preferably connected to a wall stud 250 with the first section 226 extending along an inner side of the stud, the second section 228 extending along the front face of the stud, and the attachment section 230 extending outwardly from the stud. As illustrated in FIGS. 11 and 12, a lag bolt 252 or other type of fastener is passed through the bore 234 in the second section 228 of the bracket 220 into the front face of the stud 250. Optionally, a screw 251 or other type of known fastener may be passed through one or both of the bores 238 and 240 into the inner side of the stud 250 to attach the bracket 220 to the stud. The longitudinal axis of the fasteners 251 are generally perpendicular to the longitudinal axis of fastener 252, as are the portions of the bracket 220 through which the fasteners extend.

As seen in FIG. 16, when a water heater 222 is being restrained, two brackets 220 are preferably used, with each bracket connected to a stud 250 positioned on opposite sides of the water heater. As illustrated therein, the "inner" side of the stud 250 is that side of the stud which faces in the direction of the item being secured. Once each bracket 220 is in position, drywall or other wall covering 254 may be placed over the studs 250. When so installed, the attachment section 230 of the bracket 220 extends through a hole or slot 256 in the wall covering 254. In this manner, the remainder of the bracket 220 and its attachment to the stud 250 is hidden behind the wall covering 254. The slot 256 in the wall covering 254 through which the attachment section 230 of the bracket 220 extends may either be pre-formed, or may be formed by punching the bracket 220 through the wall covering. To facilitate punching the bracket 220 through the wall covering, the free end of the attachment section 230 of the bracket has angled sections 244 and 246 as shown in FIG. 15.

Once the brackets 220 are installed, a first water heater restraining strap 212 is connected to one bracket and a second water heater restraining strap 214 is connected to the other bracket. In particular, each end of the straps 212, 214 includes one or more through-holes 226, and the straps 212, 214 are attached to the attachment section 230 of the brackets 220 with a fastener, such as a bolt 258 threadably connected to a nut 260, but any type of fastener may also be used. Additionally, the first sections 226 of each bracket 220 may be fastened to the side of the stud 250 by fasteners 251, such as nails or screws. As shown in FIG. 16, the straps 212 or 214, which preferably comprise any of the embodiments previously described, are positioned around the water heater 222. The straps 212, 214 are preferably tightened around the water heater 222 using one or more of the embodiments described above. In the version illustrated in FIG. 16, the straps 212, 214 are connected by a pair of connectors 40 which are connected by an adjustable fastener 90.

One of the significant advantages of the bracket 220 of the present invention is that it is not mounted externally to the wall covering 254. Instead, the bracket 220 is directly attached to the stud 250, with only a small portion thereof protruding through the wall covering 254. This offers advantages for the installer, including making it unnecessary to "hunt" for the stud 250 after the wall covering 254 is installed.

Another advantage is that the fastener 252 is at right angles to fasteners 251, so that one fastener is placed in shear when forces are exerted on the attachment section 230—which provides a stronger connection with the stud 250. The arrangement also pulls one portion 226, 228 of the bracket into the stud 250 during many types of loading and thus also provides a stronger connection. The brackets 220 may be placed on either side of a stud 250, but are preferably fastened so that a load on the strap 212 pulls the bracket into the stud and places one or both fasteners 251, 252 in shear.

An alternate form of the bracket 320 is illustrated in FIGS. 17 and 18A–C. Bracket 320 is similar to that described above, except that the attachment section 330 of the bracket 320 includes an expanded diamond-shaped section 332 for acceptance of a similar section 333 on the end of the strap 312. In this manner, the strap 312 and bracket 320 may be connected to one another by a pin 336. Desirably the pin 336 has a head 337 at one end and an opening 338 at the other end. The pin 336 is configured to fit through the diamond-shaped section 332 and a clip 340 or other member may be inserted through the opening 338 to hold the pin in the desired location. In use, the diamond-shaped section 333 of the strap 312 engages the diamond-shaped portion 332 in the bracket 320 and the pin 336 is inserted through both diamond-shaped sections to attach the strap to the bracket.

Figure 19:
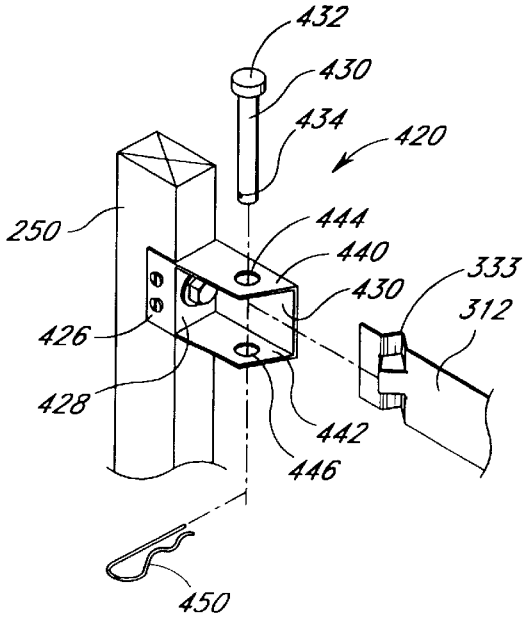
FIG. 19 illustrates yet another embodiment bracket in accordance with the present invention the bracket having yet another structure for connection of a strap thereto with a pin.

Yet another form of the bracket 420 is illustrated in FIG. 19. In this figure, the bracket 420 includes a top flange 440 and bottom flange 442 which extend horizontally outward. The flanges 440 and 442 have aligned bores 444 and 446 respectively, for accepting a pin 430 with a head 432 and an aperture 434. A strap similar to that illustrated in FIG. 17 may be connected to the bracket 420 by extending the pin 430 through the bore 444 in the top flange 440 through the expanded diamond-shaped section 333 of the strap, and then through the bore 446 in the bottom flange 442. A clip 450 or other type of fastener may then be inserted through the opening 434 in the pin 430 to secure the pin in the desired position.

A wide variety of configurations are contemplated for the attachment sections 220, 320 and 420 for use in connecting a restraining strap thereto other than those illustrated and described. For example, the given dimensions and configurations are for use with 2 inch by 4 inch studs that are commonly used during construction. Other dimensions and configurations are suitable and could be devised given the enclosed information. For example, the length of the first section 226 could extend for varying distances along the stud it preferably abuts. Similarly, the middle or second section 228 could extend for only a portion of the width of the stud that it preferably abuts. Advantageously, the middle or second section 228 does not extend substantially beyond the adjacent stud 250. Preferably the second section 228 bends outward, away from the adjacent stud 250, at a location over the stud 42.

In further variations, the first portion 226 could extend for a predetermined distance along the length of the stud 250 to provide increased stability. Similarly, the second portion 228 could extend for a predetermined distance along the length of the stud 250, with fasteners at opposite ends of the elongated second portion 228, in order to provide increased stability. Further, the Z-shaped bracket 220 or the wedge shaped bracket 140 could be modified to contain a hole axially aligned to cooperate with fastener 90 and a connector 36, 50, 60, 70 or 80 connected to one strap 12, 14, 104, etc.

Figure 20:
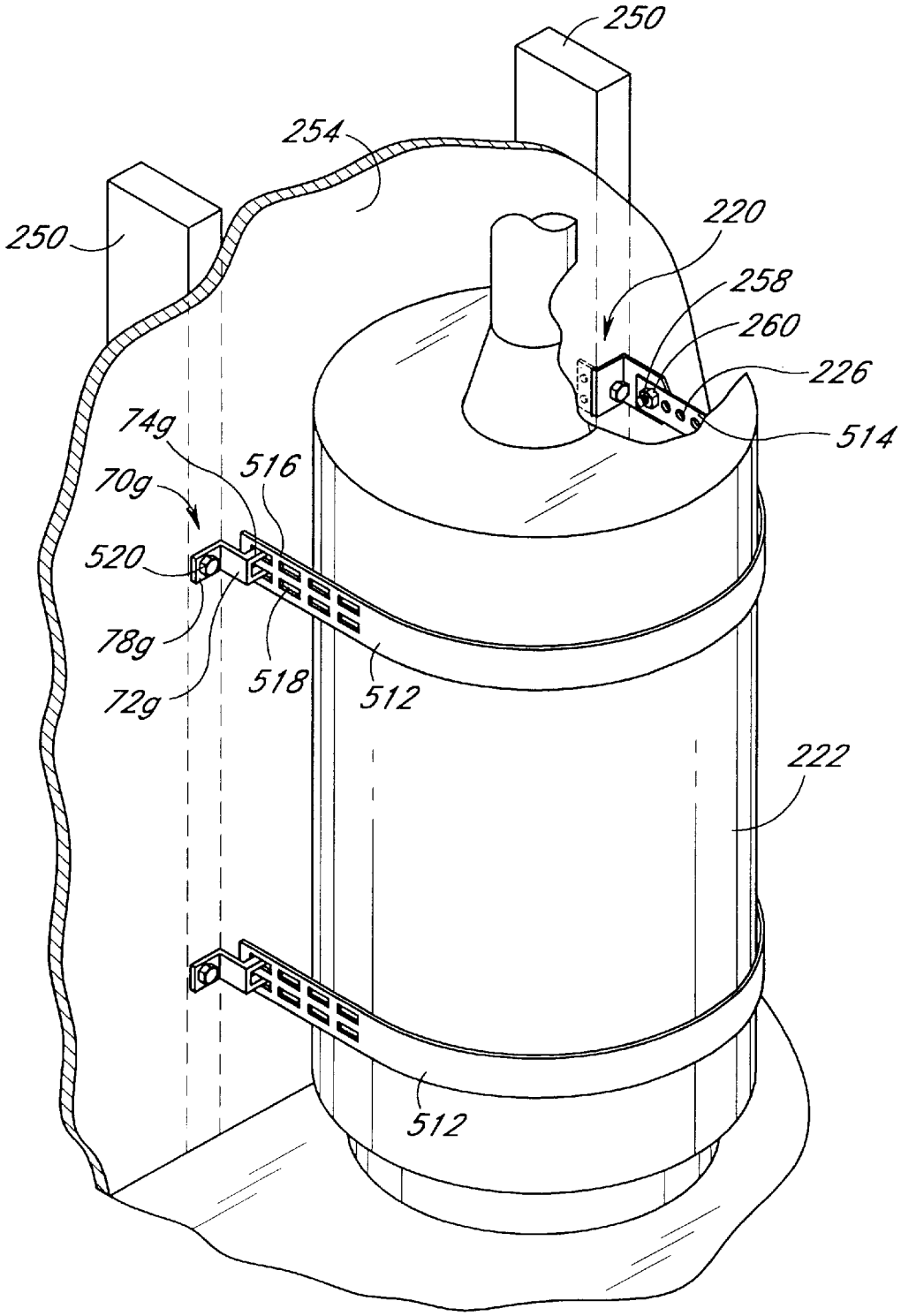
FIG. 20 is a perspective view of a preferred embodiment of the present invention.

It will be understood that a single strap 512 may also be used to restrain a component such as a water heater 222 in a desired upright position. For example, as shown in FIG. 20, the first end 514 of the strap 512 is connected to a bracket 220 by a fastener such as a bolt 258 and nut 260. The strap 512 extends around the water heater 222 and the second end 516 of the strap includes one or more apertures or openings 518. A connector is then inserted into the desired opening or openings, and the strap 512 is then cut, trimmed or bent such that the connector is located at the end of the strap. In particular, as shown in FIG. 20, connector 70*g* is used and is fastened to a stud 250 by a fastener 520 such as a screw. It will be appreciated that various types of connectors, such as connectors 36, 50, 60, 70 or 80 described above, may also be connected directly to the wall by threaded fastener, or connected to a bracket connected to the wall, in order to hold one end of a threaded fastener that can adjust the tightness of the strap.

Another embodiment of the connector is shown in FIGS. 21 to 24. In this embodiment, the connector 600 includes an elongated body 602 with an extension 604 located at one end of the body. The extension 604 is preferably positioned at about a 90° angle relative to the body 602 to form a generally L-shaped member, but the extension 604 can be located at any desired angle relative to body 602. While the width of the elongated body 602 is preferably slightly greater than the width of the straps 12, 14, the elongated body can have any desired size, and the body may have any desired configuration, such as square or circular. The elongated body 602 is advantageously rectangular in configuration with a length of about 2 inches (5.1 cm) and a width of about 1.6 inches (4.1 cm).

The elongated body 602 has an upper surface 606 with one or more upwardly extending portions or tabs 608. It will be appreciated that while words such as "upper" and "lower" are used to describe the components of the restraining system 10 shown in the accompanying figures, the present invention can be located in any desired position including, for example, various angles, sideways and even upside down. It will also be appreciated that the tabs 608 are intended to include a variety of differently shaped protrusions or members which are suitable for the intended purpose of the tabs. The tabs 608 are located along the longitudinal axis of the elongated body 602 and the tabs 608 are preferably centrally located between the opposing edges 610 and 612 of the elongated body. As discussed below, the tabs 608 are configured to engage the slots 32, 34 in the straps 12, 14.

Figure 21:
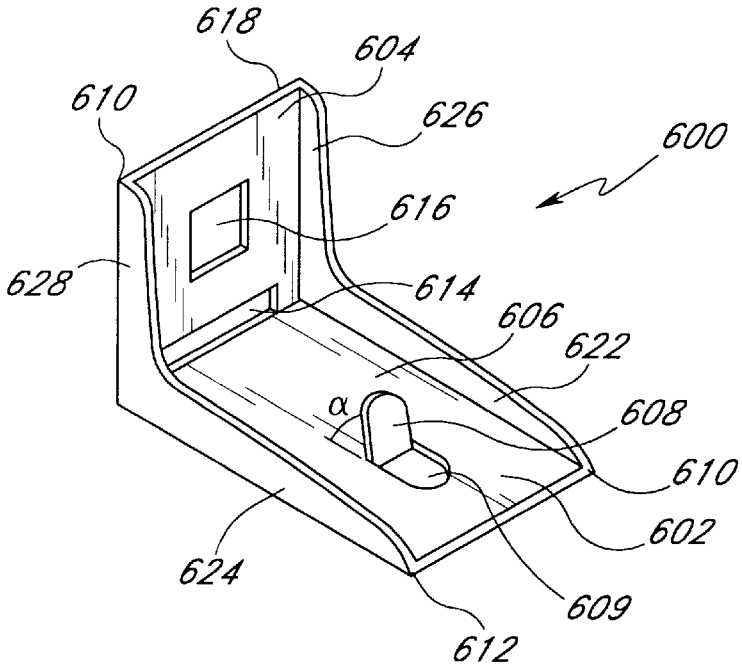
FIG. 21 and 21*a* are perspective views of another embodiment of the connector.
Figure 22:
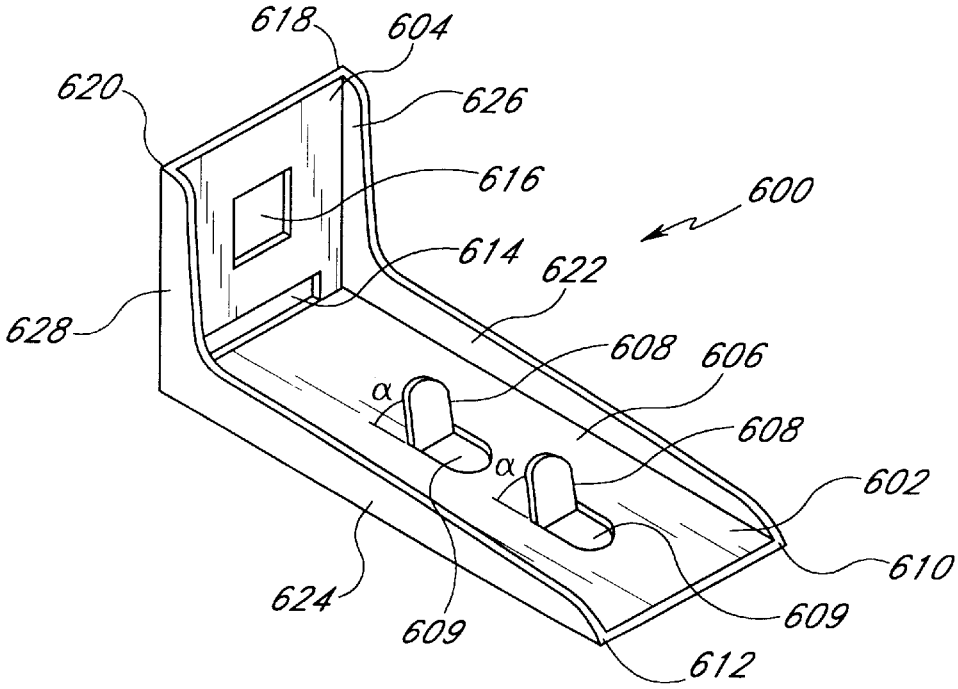
FIG. 22 is a perspective view of still another embodiment of the connector.
Figure 21A:
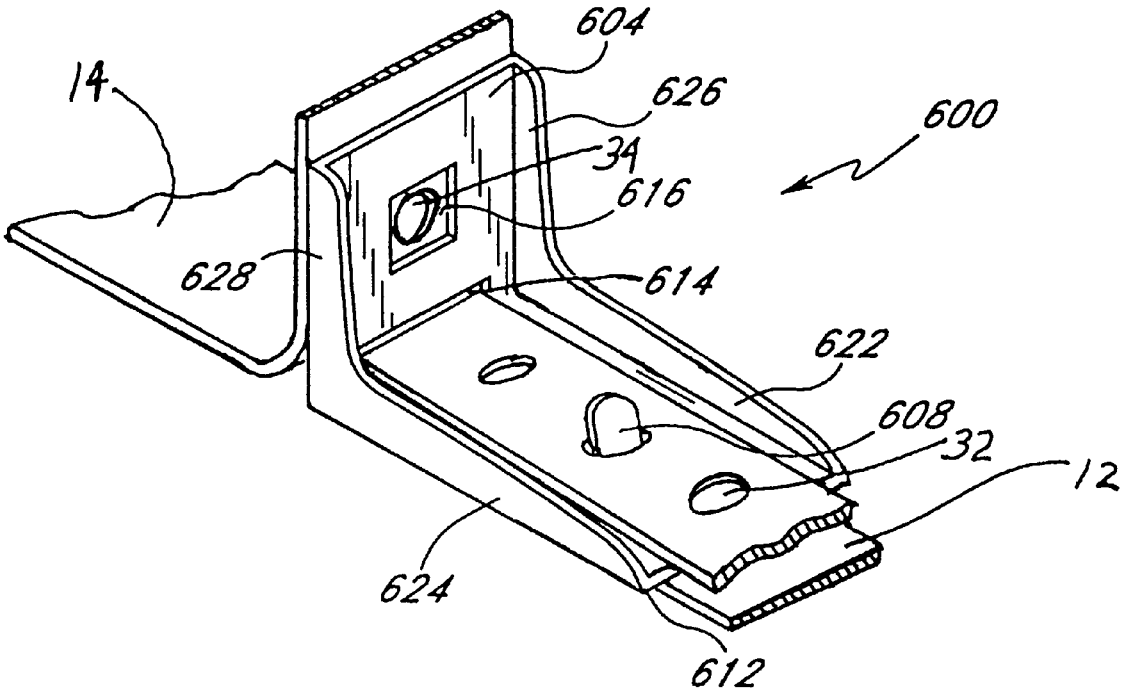
Figure 23:
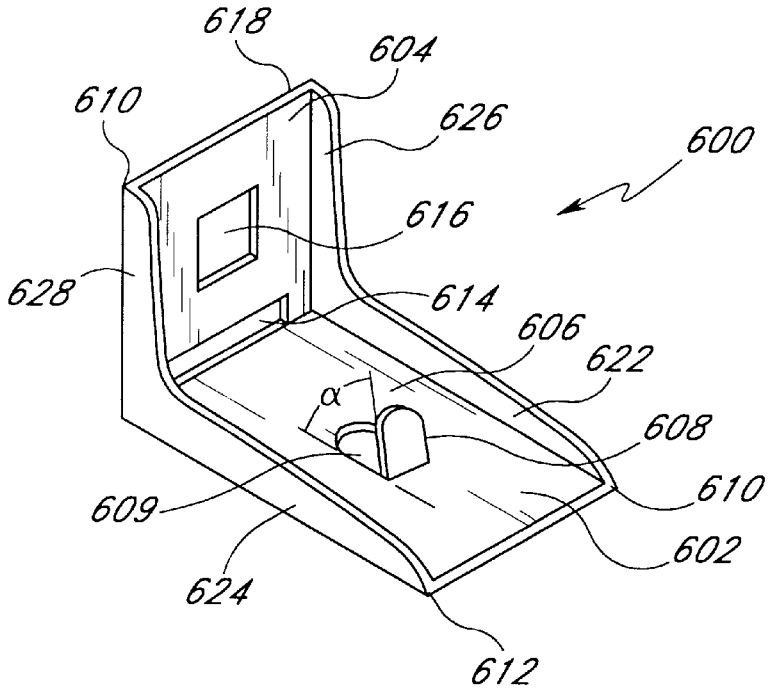
FIG. 23 is a perspective view of yet another embodiment of the connector.
Figure 24:
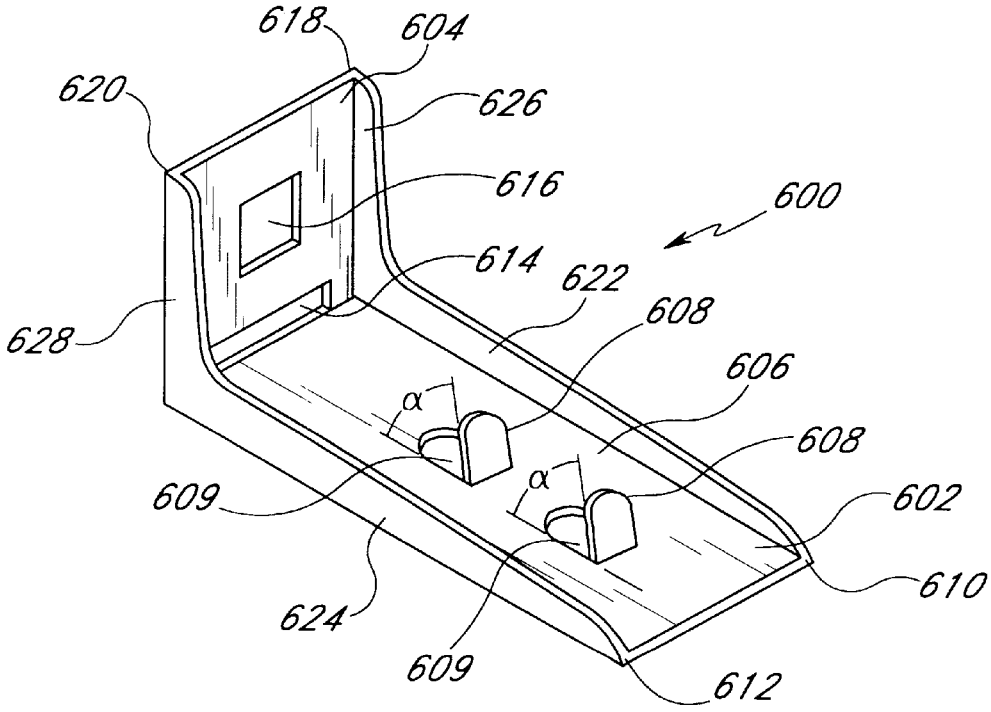
FIG. 24 is a perspective view of another embodiment of the connector.

The one or more tabs 608 advantageously have a generally similar size and configuration. In particular, the tabs 608 have a height and width, which is measured at the base of the tab proximate the upper surface 606 of the elongated body 602, in the range of about 0.25 inches (0.63 cm) to about 0.5 inches (1.3 cm). The tabs 608 more have a height and width of about 0.375 inches (0.95 cm), but the tabs can also be larger or smaller. The tabs 608 are positioned at an angle $\alpha$ relative to the upper surface 606 of the body 602. The tabs 608 are preferably at an angle $\alpha$ between about 30° and about 80°, and more preferably at an angle $\alpha$ of about 60°, but the angle $\alpha$ can be greater or lesser. The tabs 608 may have a rounded upper surface to prevent dangerous sharp edges, which increase the safety for a person installing or using the connector 600, but the tabs 608 may have any desired shape. The tabs 608 are preferably formed by punching or cutting out a generally "U"-shaped portion of the body 602 and then bending the tab to the desired angle. This forms an opening 609 in the elongated body 602 of the connector 600. As shown in FIGS. 21 and 22, the opening 609 may be located on the side of the tab 608 away from the extension 604 or, as shown in FIGS. 23 and 24, the opening 609 may be located on the side of the tab 608 towards the extension 604.

As shown in FIG. 21, the connector 600 may include a single tab 608 which is configured to fit through and engage a selected slot 32, 34 in either strap 12, 14 respectively. As shown in FIG. 22, the connector 600 may also include two tabs 608 which are separated by a distance approximately equal to the distance separating the slots 32, 34 in the straps 12, 14. For example, the tabs 608 may be separated by a distance of about 1 inch (2.54 cm) if the distance between adjacent slots 32, 34 in the strap 12, 14 is similarly about 1 inch (2.54 cm). It will be understood the distance between the tabs 608 can vary accordingly to the distance between adjacent slots 32, 34; and the distance between the tabs can be a multiple of the distance between the slots. Additionally, the tabs 608 can be arranged in any desired locations, for example, but without limitation, the tabs may be positioned in a side-by-side arrangement between the edges of the elongated body.

The extension 604 located at the end of the connector 600 may have generally rectangular or square in configuration with a height between about 1 inch (2.5 cm) and 2.0 inches (5.1 cm) and a width of about 1.6 inches (4.1 cm), but the extension can have any desired shape or size suitable for its intended purpose. The extension 604 includes a slot or opening 614 which is configured to receive either strap 12 or 14. The opening 614 is preferably sized slightly larger than the strap 12, 14 and it is located proximate the intersection of the elongated body 602 and the extension 604. More preferably, the lower surface of the opening 614 is aligned with the upper surface 606 of the elongated body 602 to create a generally planar surface. The extension 604 also includes an aperture 616 configured to receive an adjustable fastener, such as the adjustable fastener 90 discussed above. The aperture 616 shown in FIGS. 21 and 22 is square with sides about 0.25 inches (0.63 cm) in length, but the aperture may have any desired size and configuration suitable for its intended purpose. The opening 614 and aperture 616 are preferably centrally located between the edges 618 and 620 of the extension 604.

Attached to the edges 610 and 612 of the elongated body 602 are sidewalls 622 and 624, and attached to the edges 618 and 620 of the extension 604 are sidewalls 626 and 628. The sidewalls 622, 624, 626 and 628 provide additional support and strength for the connector 600, and the sidewalls 622 and 624 may assist in properly positioning the straps 12 or 14 along the upper surface 606 of the elongated body 602. The sidewalls 622, 624, 626 and 628 are preferably tapered at the distal ends of the elongated body 602 and extension 604, respectively, and the greatest height of each sidewall is preferably at the intersection of the body and the extension. The sidewalls 622 and 626 on one side of the connector 600, and sidewalls 624 and 628 on the other side of the connector are preferably integral one-piece units formed from a single piece of metal to advantageously increase the strength of the connector 600, but the sidewalls may also be fastened together by any known means such as bolts, screws, adhesives or welding. Alternatively, the sidewalls 622, 624, 626 and 628 may comprise individual components which are not connected together. The sidewalls 622 and 624 preferably extend upwardly from the upper surface 606 of the elongated body 602 to help position and align the strap 12, 14 along the upper surface 606 of the body 602, but the sidewalls may also be attached to the lower surface of the body.

The connector 600 is desirably constructed from 12 gauge steel, but it can also be constructed from other metals such as aluminum or other materials such as plastic, provided these materials have sufficient strength for the intended use of the connector. The connector 600 is manufactured by punching, cutting or drilling the elongated body 602, extension 604, tabs 608, opening 614 and aperture 616 from a sheet of steel, and then bending or forming the steel into the desired configuration. Alternatively, the connector 600 may comprise two or more components which are fastened together. For example, the elongated body 602, extension 604 and sidewalls 616 may be separate components which are fastened together by any type of known fasteners such as bolts, screws, adhesives or welding.

In use, a strap 12, 14 is inserted through the opening 614 at about a 45° relative to the upper surface 606 of the elongated body 602. When the connector 600 and the strap 12, 14, are positioned such that the one or more tabs 608 are aligned with the desired slots 32, 34 in the straps, the connector and/or strap is rotated such that the tabs are inserted through the desired slots. The tabs 608 are desirably located at an angle to prevent the unintended movement of the strap relative to the connector. The end of the strap 12, 14 which extends through the opening 614, is then folded or bent under the lower surface of the body 602 connector 600 to prevent the strap from slipping or moving relative to the connector. Alternatively, the strap 12, 14 could be cut so that the strap does not have to be folded under the body 602 of the connector 600. In addition, in an alternative embodiment, the opening 614 may be eliminated and the strap 12, 14 is cut or bent upwardly such that the tabs 608 engage the slots 32, 34 at the end of the strap 12, 14. This eliminates the need for the opening 614 in the extension 604. Any type of adjustable fastener, as discussed above, is then inserted through the aperture 616 for fine adjustment of the strap 12, 14 about the water heater 16.

In another alternative embodiment, the connector 600 may have one or more apertures extending through the elongated body 602 rather than the upwardly extending tabs 608. The strap 12, 14 is attached to the connector 600 by inserting one or more fasteners, such as a bolt, through apertures in the body and the desired slots 32, 34 in the straps. The bolt can then be secured in position by attaching a nut to the threaded end. Thus, the fastener allows the strap 12, 14 to be securely fastened to the connector 600.

The various components of the restraining system 10, such as the connectors, brackets and wedges, are preferably made of metal. Advantageously, these components are made of steel. Other types of metal, such as aluminum, may also be used to construct the restraining system 10. It is believed possible that non-metal materials, such as certain plastic compounds or fabrics, could be suitable for some or all of these components of the restraining system 10 provided the components satisfy the appropriate strength and durability requirements. Given the above disclosure, one skilled in the art can devise other ways of implementing the teaching of this disclosure to achieve the inherent advantages and features of this invention.

Additionally, this restraining system 10 is not limited to use with water heaters, but may be used with other objects such as water tanks, storage tanks, boilers, pressure vessels and other types of receptacles and storage chambers. It will be appreciated that the present invention can also be used with any item that may be restrained from movement by connecting to a support or a support surface.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A restraining system for securing a water heater to a support structure, comprising:

a first strap having a first end and a second end separated by a length, said second end including a plurality of openings;

a first connector selectively connectable to at least one of said plurality of openings in said first strap, said first connector having an elongated body with one or more tabs, each of said tabs configured to fit through one of said plurality of openings in said first strap, the number of openings being greater than the number of tabs, said first connector having a first opening through which the first strap passes;

a second strap having a first end and a second end separated by a length, said second end including a plurality of openings;

a second connector selectively connectable to at least one of said plurality of openings in said second strap, said second connector having an elongated body with one or more tabs, each of said tabs configured to fit through one of said plurality of openings in said second strap, said second connector having a second opening through which the second strap passes; and an adjustable fastener configured to connect said first connector and said second connector and to move the connectors relative to each other.

2. The restraining system of claim 1, wherein said first connector includes an extension including an aperture, wherein said second connector includes an extension including an aperture, and wherein said adjustable fastener is inserted through said aperture in said first connector and said aperture in said second connector to connect said first connector and said second connector.

3. The restraining system of claim 2, wherein said one or more tabs in said first connector are at an angle of about 60° with respect to said elongated body towards said extension and wherein said one or more tabs in said second connector are at an angle of about 60° with respect to said elongated body towards said extension.

4. The restraining system of claim 2, wherein said first connector extends from an interior side of said strap located toward the water heater when in use and toward an toward an exterior side of the strap located away from the water heater when in use, the extension of the first connector being, located on the exterior side of the strap, and wherein the second connector extends from an interior side of said strap when in use and toward an exterior side of the strap, the extension of the second connector being located on the exterior side of the strap.

5. The restraining system of claim 1, wherein said plurality of openings in said first strap include a plurality of adjacent openings each separated by a first distance and said one or more tabs in said first connector comprise two tabs which are separated by said first distance; and wherein said plurality of openings in said second strap include a plurality of adjacent openings each separated by a second distance and said one or more tabs in said second connector comprise two tabs which are separated by the second distance.

6. The restraining system of claim 1, further comprising a sidewall connected to each elongated edge of said elongated body.

7. The restraining system of claim 1, wherein said first connector extends from an interior side of said strap located toward the water heater when in use and toward an toward an exterior side of the strap located away from the water heater when in use, the first connector having an extension located on the exterior side of the strap, the extension including an aperture through which said adjustable fastener is inserted.

8. The restraining system of claim 1, wherein the first strap bends backward along a length of the first strap so the elongated body of the first connector has a portion of the first strap adjacent opposing sides of the first connector.

9. A restraining system for securing a water heater to a support structure, comprising:

a first strap having a first end adapted to be connected to the support structure, said first strap having a plurality of holes at a distal, second end of the first strap;

a second strap having a first end adapted to be connected to the support structure, said second strap having at least one hole at a distal, second end of the second strap;

a connector having an extension and elongated body with one or more tabs but fewer tabs than the plurality of holes, said extension having an aperture and also having an opening configured to receive said first strap; and an adjustable fastener configured to extend through said aperture in said extension in said connector and to further extend through said at least one hole in the second end of the second strap to move the distal ends of the two straps relative to each other.

10. The restraining system of claim 9, wherein said one or more tabs in said connector are at an angle of about 60° towards said extension with respect to said elongated body.

11. The restraining system of claim 9, wherein said one or more tabs in said connector comprise two tabs which are separated by a distance generally equal to a distance separating adjacent openings in said plurality of openings in said first strap.

12. The restraining system of claim 9, further comprising a sidewall connected to each elongated edge of said elongated body.

13. A restraining system as defined in claim 9, wherein the connector has two opposing sides with the first strap bending back on itself so the first strap is adjacent each of the opposing sides of the connector.

14. The restraining system as defined in claim 9, wherein the connector extends from an interior side of the first strap located toward the water heater when in use and toward an exterior side of the first strap located away from the water heater when in use, the extension being located on the exterior side of the first strap.

15. A restraining system which secures a water heater to a support structure, the restraining system including a strap having a first end and a second end, the first end connected to the support structure, and a connector connected to the second end, the connector comprising:

an elongated body with at least one tab extending from the body; and an extension attached to an end of said elongated body, said extension including an opening configured to receive the strap, and wherein the connector has two opposing sides with the strap bending back on itself so the first strap is adjacent each of the two opposing sides of the connector, said at least one tab extending through a hole in the second end of the strap.

16. The restraining system of claim 15, wherein said lone or more tabs in at least one tab is at an angle of about 60° towards said extension with respect to said elongated body.

17. The restraining system of claim 15, wherein said second end of the strap contains a plurality of holes separated by a distance and wherein said at least one tab comprises two tabs which are separated by a distance generally equal to the distance separating adjacent holes in the second end of the strap.

18. The restraining system of claim 15, further comprising a sidewall connected to each elongated edge of said elongated body.

19. The connector as defined in claim 15, wherein the connector extends from an interior side of the first strap adapted to be located toward the water heater when in use and toward an exterior side of the first strap adapted to be located away from the water heater when in use.

20. A method of restraining a water heater from movement, comprising:

providing a first strap having a first end and a second end, said second end including a plurality of holes;

providing a second strap having a first end and a second end, said second end including a plurality of holes;

providing a first connector with an elongated body and an extension, said elongated body including one or more tabs, said extension including an opening and an aperture;

inserting said first strap through said opening in said first connector;

aligning said one or more tabs to selected holes of said plurality of holes in said first strap;

inserting said one or more tabs of said first connector through said selected holes in said first strap;

providing a second connector with an elongated body and an extension, said elongated body including one or more tabs, said extension including an opening and an aperture;

inserting said second strap through said opening in said second connector;

aligning said one or more tabs to selected holes of said plurality of holes in said second strap;

inserting said one or more tabs of said second connector through said selected holes in said second strap;

connecting said first connector and said second connector with an adjustable fastener, said adjustable fastener configured to tighten said first strap and said second strap around the water heater.

21. The method as defined in claim 20, wherein the step of inserting the first strap through the opening in the first connector comprises the step of inserting the connector from an interior side of the first strap located toward the water heater and toward an exterior side of the first strap located away from the water heater.

22. The method as defined in claim 20, wherein the step of inserting the first strap through the opening in said first connector further comprises the step of bending the first strap backwards on itself so the first strap is adjacent each of the two opposing sides of the connector.

23. A method of restraining a water heater from movement, comprising:

providing a first strap having a first end and a second end, said second end including a plurality of holes;

providing a second strap having a first end and a second end, said second end including a plurality of holes;

attaching a first connector to one or more selected holes from said plurality of holes in said first strap, said first connector including an elongated body with one or more tabs configured to extend through said one or more selected holes from said plurality of holes in said first strap, the number of tabs being less than the plurality of holes in said first strap and said one or more selected holes selected for coarse adjustment of said first strap around the water heater, said first connector including an extension with an aperture and further including a slot through which said first strap passes;

attaching a second connector to one or more selected holes from said plurality of holes in said second strap, said second connector including an elongated body with one or more tabs configured to extend through said one or more selected holes from said plurality of holes in said second strap, said one or more selected holes selected for coarse adjustment of said second strap around the water heater, said second connector including an extension with an aperture and further including a second slot through which said second strap passes; and inserting an adjustable fastener through said apertures in said first connector and said second connector to adjustably connect said first connector and said second connector to provide fine adjustment of the first and second straps around the water heater.

24. The method as defined in claim 23, wherein the step of inserting the first strap through the opening in the first connector comprises the step of inserting the connector from an interior side of the first strap located toward the water heater and toward an exterior hide of the first strap located away from the water heater.

25. The method as defined in claim 23, wherein the step of inserting the first strap through the opening in said first connector further comprises the step of bending the first strap backwards on itself so the first strap is adjacent each of the two opposing sides of the connector.

26. A method of restraining a water heater from movement, comprising:

attaching a first end of a first strap to a supporting structure, said first strap including a plurality of holes;

attaching a first end of a second strap to a supporting structure, said second strap including a plurality of holes;

attaching a first connector to selected holes of said plurality of holes in said first strap, said first connector including an elongated body with one or more tabs, the number of tabs being less than the plurality of holes in the first strap, said first connector including an extension with an aperture and further including a first slot through which said first strap passes;

attaching a second connector to selected holes of said plurality of holes in said second strap, said second connector including an elongated body with one or more tabs the number of tabs being less than the plurality of holes in the second strap, said second connector including an extension with an aperture and further including a second slot through which said second strap passes; and connecting said first connector and said second connector with an adjustable fastener, said adjustable fastener configured to tighten said first strap and said second strap around the water heater.

27. The method as defined in claim 26, wherein the step of inserting the first strap through the opening in the first connector comprises the step of inserting the connector from an interior side of the first strap located toward the water heater and toward an exterior side of the first strap located away from the water heater.

28. The method as defined in claim 26, wherein the step of inserting the first strap through the opening in said first connector further comprises the step of bending the first strap backwards on itself so the first strap is adjacent each of the two opposing sides of the connector.

29. A restraining system which secures a water heater to a support structure, comprising:

a strap having one end fastened to the structure and extending at least partially around the water heater;

a plate having opposing interior and exterior sides with the interior side facing the water heater and the exterior side facing away from the water heater during use with an extension extending generally perpendicular from the exterior side of the plate at one end of the plate, the extension having a hole therein sized to receive a fastener, the plate having at least one tab extending therefrom, a slot being formed in one of the plate and extension proximate the intersection of the plate and extension, the slot being sized to allow the strap to pass therethrough, the strap extending through the slot and resting against the exterior surface of the plate with the tab engaging a hole in the strap to restrain movement of the strap relative to the plate, and wherein the strap extending through the slot is bent backwards and placed against the interior side of the plate.

30. The restraining system of claim 29, wherein the slot is located in the extension.

31. The restraining system of claim 29, wherein the slot is located in the plate.

32. The restraining system of claim 29, wherein the strap contains a plurality of equally spaced holes and there are at least two tabs extending from the exterior side of the plate and inclined toward the extension, the tabs having a spacing corresponding to the spacing of the equally spaced holes in the strap, the tabs extending through the holes.

* * * * *

UNITED STATES PATENT AND TRADEMARK OFFICE

CERTIFICATE OF CORRECTION

PATENT NO. : 6,095,472
DATED : August 1, 2000
INVENTOR(S) : Hubbard et al.

It is certified that error appears in the above-identified patent and that said Letters Patent is hereby corrected as shown below:

Claim 16,
Lines 56-57, delete "lone or more tabs in".

Signed and Sealed this

Eleventh Day of September, 2001

*Attest:*

Nicholas P. Godici

*Attesting Officer*

NICHOLAS P. GODICI
*Acting Director of the United States Patent and Trademark Office*